US010842229B2

(12) United States Patent
Mou et al.

(10) Patent No.: US 10,842,229 B2
(45) Date of Patent: Nov. 24, 2020

(54) PRESSURE FIXING DEVICE APPLIED TO SHOE

(71) Applicant: Microjet Technology Co., Ltd., Hsinchu (TW)

(72) Inventors: Hao-Jan Mou, Hsinchu (TW); Li-Pang Mo, Hsinchu (TW); Shih-Chang Chen, Hsinchu (TW); Yung-Lung Han, Hsinchu (TW); Wei-Ming Lee, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 15/992,964

(22) Filed: May 30, 2018

(65) Prior Publication Data

US 2019/0000186 A1 Jan. 3, 2019

(30) Foreign Application Priority Data

Jul. 3, 2017 (TW) ..... 106122223 A

(51) Int. Cl.
*A43B 23/02* (2006.01)
*A43B 23/26* (2006.01)
(Continued)

(52) U.S. Cl.
CPC ..... *A43B 23/26* (2013.01); *A43B 3/0005* (2013.01); *A43B 11/00* (2013.01); *A43B 23/029* (2013.01);
(Continued)

(58) Field of Classification Search
CPC A43C 9/00; A43C 11/00; A43C 11/20; A43B 3/0005; A43B 23/0285;
(Continued)

(56) References Cited

U.S. PATENT DOCUMENTS 3,664,043 A 5/1972 Polumbus, Jr.
4,712,316 A * 12/1987 Baggio ..... A43B 5/0443 36/117.9
(Continued)

FOREIGN PATENT DOCUMENTS

CN 2121219 U 11/1992
CN 205696053 U 11/2016
(Continued)

OTHER PUBLICATIONS

Partial European Search Report, dated Nov. 6, 2018, for European Application No. 18174943.3.
CN Office Action dated Jun. 28, 2020; pp. 1-10.

*Primary Examiner* — Sharon M Prange
(74) *Attorney, Agent, or Firm* — Birch, Stewart, Kolasch & Birch, LLP

(57) ABSTRACT

A pressure fixing device applied to a shoe is disclosed. The pressure fixing device includes an inflatable shoe tongue, a first air pump and a control module. The control module drives the air to flow out of the inflatable shoe tongue according to a second enabling signal so that the inflatable shoe tongue tends to shrink and moves toward the wear space to attach to a user's instep. The control module drives the first air pump to pump the air flowing into the inflatable shoe tongue according to a first enabling signal, so that the inflatable shoe tongue tends to expand due to the air inflated and moves away from the wear space to enlarge the opening, by which the user can wear or take off the shoe easily.

17 Claims, 23 Drawing Sheets

(51) Int. Cl.

| | |
|---|---|
| ***A43C 9/00*** | (2006.01) |
| ***A43C 11/20*** | (2006.01) |
| ***A43B 11/00*** | (2006.01) |
| ***A43B 3/00*** | (2006.01) |
| ***A43C 11/00*** | (2006.01) |
| ***F04B 43/04*** | (2006.01) |
| ***F04B 45/047*** | (2006.01) |

(52) U.S. Cl.
CPC ..... *A43C 9/00* (2013.01); *A43C 11/00* (2013.01); *A43C 11/20* (2013.01); *F04B 43/046* (2013.01); *F04B 45/047* (2013.01)

(58) Field of Classification Search
CPC ..... A43B 23/029; A43B 23/26; A43B 11/00; A43B 9/00; A43B 7/18; A43B 7/32
See application file for complete search history.

(56) References Cited

U.S. PATENT DOCUMENTS

| | | | | | |
|---|---|---|---|---|---|
| 5,113,599 | A * | 5/1992 | Cohen | A43B 17/035 | 36/114 |
| 5,158,767 | A * | 10/1992 | Cohen | A43B 5/0407 | 36/114 |
| 5,588,227 | A | 12/1996 | Goldston et al. | | |
| 6,014,823 | A | 1/2000 | Lakic | | |
| 6,122,785 | A * | 9/2000 | Bondie | A42B 3/121 | 5/655.3 |
| 6,195,914 | B1 * | 3/2001 | Otis | A43B 3/105 | 36/11.5 |
| 7,219,449 | B1 * | 5/2007 | Hoffberg | A43B 1/0054 | 36/29 |
| 7,478,488 | B1 * | 1/2009 | Davis | A43B 7/081 | 36/29 |
| 2002/0189135 | A1 * | 12/2002 | Hanks | A43B 1/0018 | 36/54 |
| 2005/0097779 | A1 * | 5/2005 | Fang | A43B 23/26 | 36/54 |
| 2014/0165427 | A1 * | 6/2014 | Molyneux | A43B 3/0005 | 36/102 |
| 2016/0076530 | A1 * | 3/2016 | Chen | F04B 45/047 | 417/413.2 |
| 2016/0174657 | A1 | 6/2016 | Fox-Mudge | | |
| 2017/0215516 | A1 * | 8/2017 | Silva | A43B 11/00 | |
| 2019/0000188 | A1 * | 1/2019 | Mou | A43C 11/008 | |
| 2019/0208855 | A1 * | 7/2019 | Raia | A43B 3/163 | |

FOREIGN PATENT DOCUMENTS

| | | | | |
|---|---|---|---|---|
| CN | 206129568 U | | 4/2017 | |
| DE | 10247810 A1 | | 4/2004 | |
| TW | 200901908 | * | 1/2009 | A43C 9/00 |
| TW | 200901908 A | | 1/2009 | |

* cited by examiner

PRESSURE FIXING DEVICE APPLIED TO SHOE

FIELD OF THE INVENTION

The present disclosure relates to a pressure fixing device applied to a shoe, and more particularly to a pressure fixing device applied to a shoe and inflated by an air pump

BACKGROUND OF THE INVENTION

Generally, shoelaces are used in most shoes as a means of loosening, tying and fixing the shoes on the feet. However, the shoes with shoelaces have many problems of inconvenience when putting on it. For example, when the shoelaces are loosened while moving, they have to be retied, resulting in inconvenience and waste of time. Furthermore, there is also potential danger of wearing shoes with shoelaces. For example, when the shoelaces are accidentally loosened, other people may trip over it, or the shoelaces may be involved in the gap of an escalator, a bicycle chain or a motorcycle pin etc., which may cause accidents. In addition, wearing the shoes with shoelaces in long term may put excessive pressure on the feet and cause discomfort.

Some shoes use other ways, such as a hook and loop fastener or a sock-type shoe body, as a means of loosening, tying, and fixing the feet. However, the hook and loop fastener has insufficient fixity, and is easily detached. The viscosity of the hook and loop fastener may decrease after using for a long period of time, resulting in inconvenience while moving, and the shoes with the hook and loop fastener are inappropriate for wearing during exercise. The sock-type shoe body also has insufficient strength to fix the feet, and the tightness cannot be adjusted according to the requirements. After using for a long period of time, the sock-type shoe body may be loose, and the requirement of fixing the feet is failed to be achieved.

On the other hand, in general, the topline opening of a conventional footwear is mainly designed based on its functionality. For example, sports shoes usually have a narrower topline opening so as to provide the better coverage and avoid being detached during the movement. However, the design of the narrower topline opening in the sports shoes doesn't facilitate the user's foot to fit with the shoe. If the topline opening of shoe is forced to widen for convenience of wearing, it will cause the topline opening to loosen and loss the functions of wrapping and protection. Alternatively, for example, casual shoes usually have a wider topline opening so as to aid the users to wear or take off easily. However, the design of the wider topline opening in the casual shoes will cause the user's foot to detach from the shoe easily, or increase the risks of injuring the user's foot or damaging the shoe.

Therefore, there is a need of providing a pressure fixing device to solve the drawbacks in prior arts, which can be applied to each of a pair of shoes and making the shoe automatically adjustable to be adapted to the personal foot shapes and comfortably wrap and fix the feet.

SUMMARY OF THE INVENTION

An object of the present disclosure provides a pressure fixing device applied to a shoe. The topline opening disposed on each of a pair of shoes can be adjustable to wrap the foot comfortably. Simultaneously, it achieves the benefits of aiding to wear/take off the shoes and fixing the foot well while wearing.

In accordance with an aspect of the present disclosure, there is provided a pressure fixing device applied to a shoe. The shoe includes a shoe body and a bottom part. The shoe body includes plural eyelets. The bottom part is connected to the shoe body to define a wear space collaboratively. The pressure fixing device includes an inflatable shoe tongue, a first air pump and a control module. The inflatable shoe tongue is connected to the shoe body. The inflatable shoe tongue is an inflatable and expandable structure with an air. An opening is collaboratively defined by the inflatable shoe tongue and the shoe body. The opening is in communication with the wear space. The first air pump is in communication with the inflatable shoe tongue. The control module is electrically connected to the first air pump. The control module drives the air flowing out of the inflatable shoe tongue according to a second enabling signal, so that the inflatable shoe tongue shrinks in a first direction toward the wear space to attach to a user's instep. The control module drives the first air pump to pump the air flowing into the inflatable shoe tongue according to a first enabling signal, so that the inflatable shoe tongue expands and bulges in a second direction away from the wear space to enlarge the opening.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
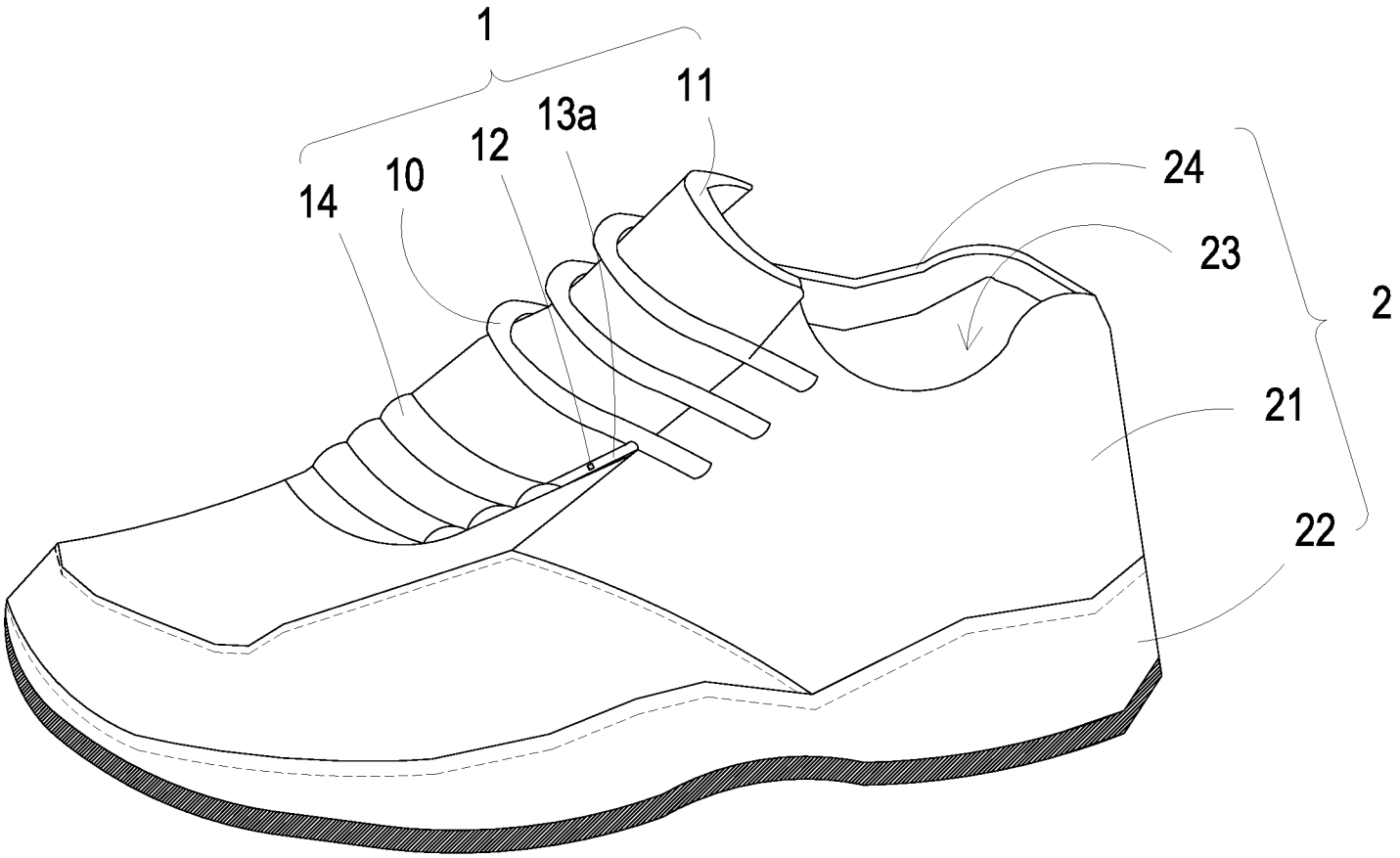
FIG. 1 is a schematic perspective view illustrating a pressure fixing device applied to a shoe according to a preferred embodiment of the present disclosure.
Figure 2:
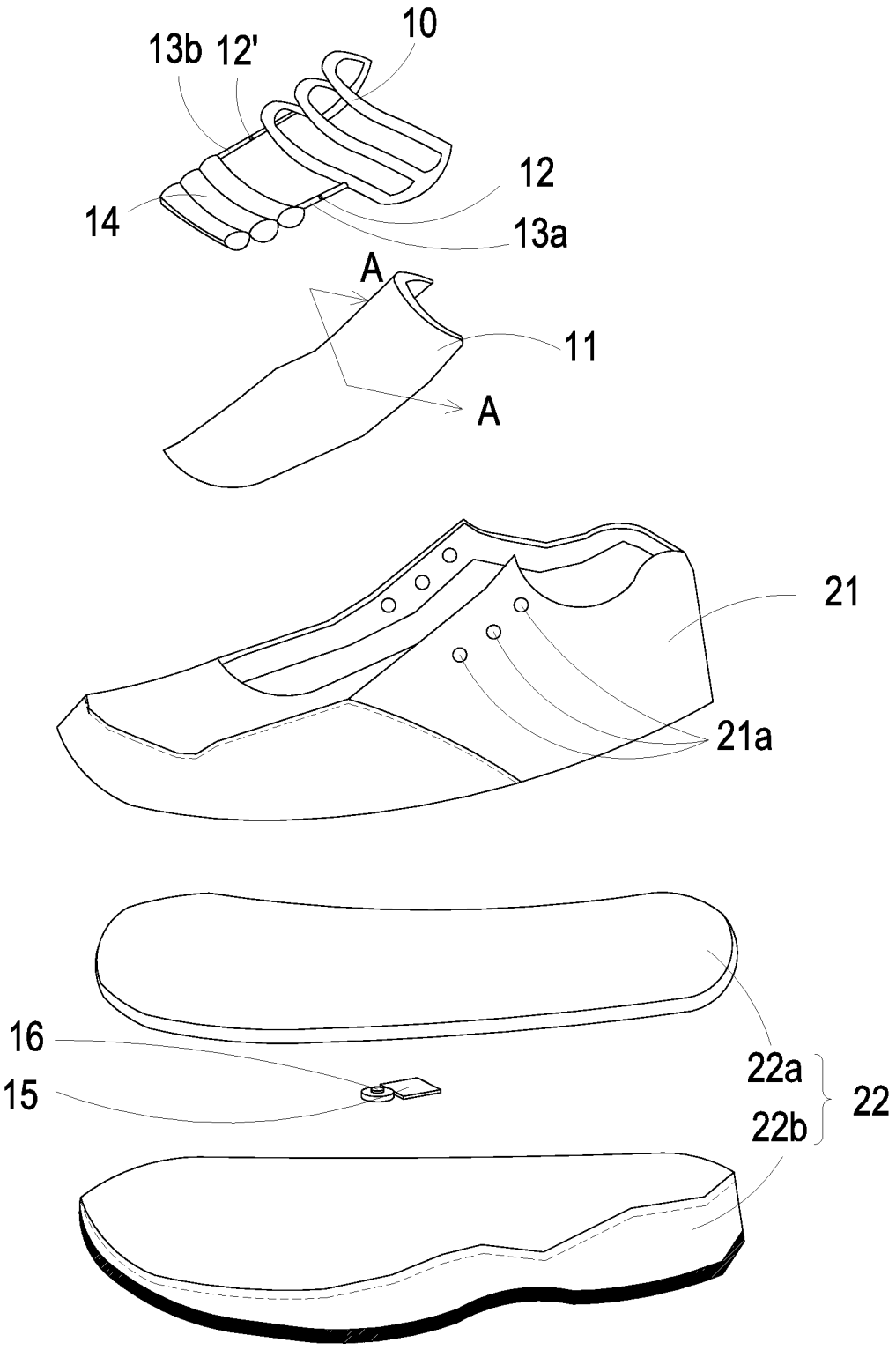
FIG. 2 is an exploded view illustrating the shoe according to the preferred embodiment of the present disclosure.

Please refer to FIGS. 1 and 2. FIG. 1 is a schematic perspective view illustrating a pressure fixing device applied to a shoe according to a preferred embodiment of the present disclosure. FIG. 2 is an exploded view illustrating the shoe according to the preferred embodiment of the present disclosure. As shown in FIG. 1, the pressure fixing device 1 of the present disclosure can be applied to various types of footwear, such as sports shoes, sandals, or high-heeled shoes, but is not limited thereto. In this embodiment, the pressure fixing device 1 is described by taking a sports shoe 2 as an example. The sports shoe 2 includes a shoe body 21 and a bottom part 22. As shown in FIG. 2, the shoe body 21 includes a plurality of eyelets 21*a* for a variety of shoelaces to wear therein. The bottom part 22 further includes a shoe pad 22*a* and a shoe sole 22*b*, wherein the shoe body 21 and the shoe sole 22*b* of the bottom part 22 are connected with each other, so as to define a wear space 23 collaboratively. The shoe pad 22*a* is disposed within and spatially corresponding to the wear space 23. Furthermore, the shoe pad 22*a* and the shoe sole 22*b* are connected with each other. The profile of the shoe pad 22*a* is substantially the same as the profile of the shoe sole 22*b*, but the outline of the shoe pad 22*a* is slightly smaller than that of the shoe sole 22*b*. The appearance and thickness of the shoe pad 22*a* and the shoe sole 22*b* can be adjustable according to the practical requirements.

Please refer to FIGS. 1 and 2 again. In this embodiment, the pressure fixing device 1 of the present disclosure includes an inflatable shoelace 10, an inflatable shoe tongue 11, a first air pump 12, a second air pump 12', an airbag 14, a control module 15, and a battery 16, but not limited thereto. The inflatable shoe tongue 11 is connected to the shoe body 21, and an opening 24 is collaboratively defined by the inflatable shoe tongue 11 and the shoe body 21. A user's foot can be inserted into or detached from the sports shoe 2 via the opening 24 of the shoe body 21. When the user's foot is inserted into the interior of the sports shoe 2 through the opening 24, the user's foot can be accommodated in the wear space 23. The airbag 14 is attached to the inflatable shoe tongue 11, adjacent to one side of the inflatable shoe tongue 11, and in communication with the inflatable shoe tongue 11. The inflatable shoelace 10 is attached to the inflatable tongue 11 and adjacent to another side of the inflatable shoe tongue 11, but not limited thereto. In this embodiment, the first air pump 12 is a one-way inlet air pump, but not limited thereto. In this embodiment, the control module 15 and the battery 16 are disposed between the shoe pad 22*a* and the shoe sole 22*b* of the bottom part 22. The control module 15 is electrically connected to the first air pump 12 and the second air pump 12'. The battery 16 is used to provide electrical power to the control module 15.

Figure 3:
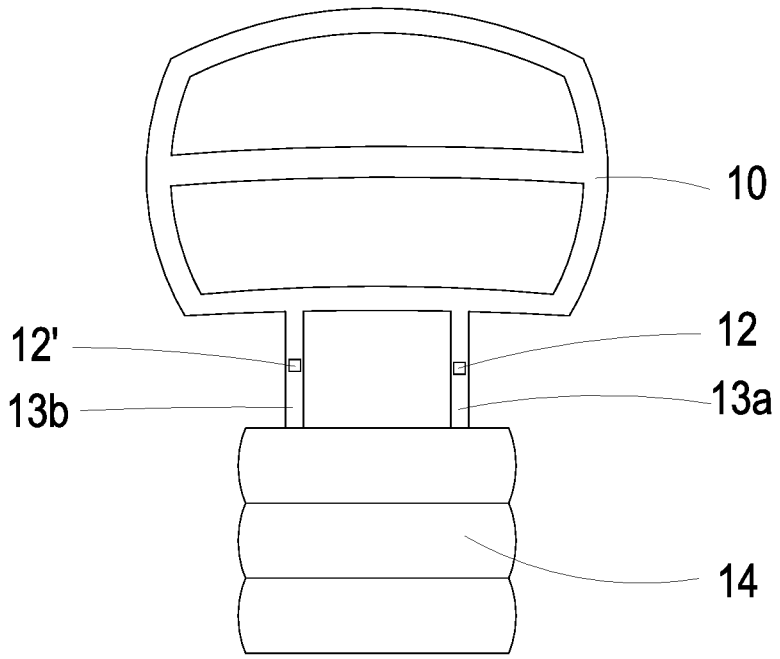
FIG. 3 schematically illustrates an inflatable shoelace of the pressure fixing device according to the preferred embodiment of the present disclosure.

Please also refer to FIGS. 2 and 3. FIG. 3 schematically illustrates an inflatable shoelace of the pressure fixing device according to the preferred embodiment of the present disclosure. As shown in FIG. 3, in the embodiment, the inflatable shoelace 10 is an inflatable and expandable structure with an air and in communication with the airbag 14 through the first air passage 13*a* and the second air passage 13*b* for transferring the air. The airbag 14 is attached on an outer surface of the inflatable shoe tongue 11. The inflatable shoelace 10 runs through the plural eyelets 21*a* of the shoe body 21. The first air passage 13*a* and the second air passage 13*b* are in communication between the airbag 14 and the inflatable shoelace 10, respectively. The first air pump 12 is disposed within and in communication with the first air passage 13*a*, and the first air pump 12 is electrically connected to the control module 15 to introduce the air from the inflatable shoelace 10 into the airbag 14, so that the inflatable shoelace 10 is deflated and loosened. Thus, it aids the user to wear or take off the sports shoe 2 easily. In addition, the second air pump 12' is disposed within and in communication with the second air passage 13*b*, and the second air pump 12' is electrically connected to the control module 15 to introduce the air from the airbag 14 into the inflatable shoelace 10, so that the air introduced from the inflatable shoe tongue 11 and the airbag 14 is filled into the inflatable shoelace 10. The air is quickly filled into the inflatable shoelace 10, and the inflatable shoelace 10 is expanded and tightened to completely attach to the upper portion of the user's instep, namely, the connecting periphery between the user's instep and the ankle. Thus, it aids the user's foot to be wrapped and fixed firmly in the shoe 2. In addition, with the two-section configuration of the inflatable shoelace 10 and the airbag 14, it prevents the shoe body 21 of the shoe 2 to be bent from pressing the user's foot uncomfortably during exercise, so as to achieve the benefits of comfort and safety. Therefore, the air is controlled to flow between the inflatable shoelace 10 and the inflatable shoe tongue 11 and between the inflatable shoelace 10 and the airbag 14 by the first air pump 12 and the second air pump 12', and the inflatable shoelace 10 is loosened or tightened, so as to achieve the benefits of aiding to wear/take off the shoes and fixing the foot well when putting on it.

Figure 4A:
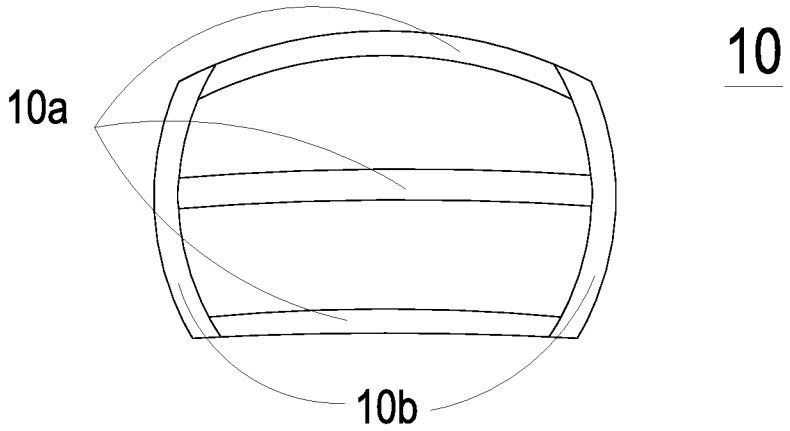
FIG. 4A schematically illustrates an inflatable shoelace in an initial status according to a first embodiment of the present disclosure.
Figure 4B:
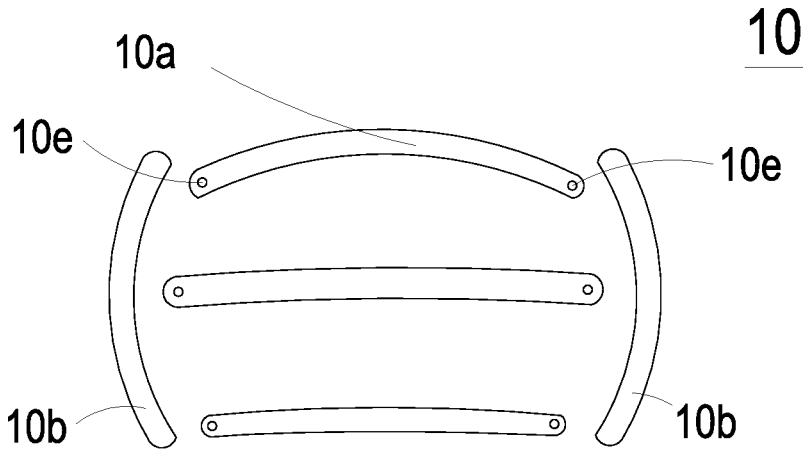
FIG. 4B is an exploded view of the inflatable shoelace of FIG. 4A.
Figure 4C:
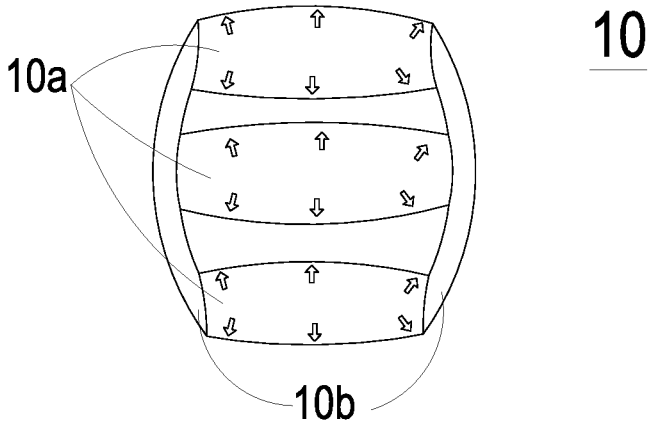
FIG. 4C schematically illustrates the inflatable shoelace of FIG. 4A to be inflated and expanded.

Please also refer to FIGS. 4A and 4B. FIG. 4A schematically illustrates an inflatable shoelace in an initial status according to a first embodiment of the present disclosure. FIG. 4B is an exploded view of the inflatable shoelace of FIG. 4A. FIG. 4C schematically illustrates the inflatable shoelace of FIG. 4A to be inflated and expanded. As shown in FIG. 4A, in the first embodiment, the inflatable shoelace 10 further includes at least one lacing part 10*a* and at least one connecting part 10*b*. In the embodiment, three lacing parts 10*a* and two connecting parts 10*b* are described, but the present disclosure is not limited thereto. The number and arrangement thereof can be adjusted according to the practical requirements. Further as shown in FIG. 4B, in the embodiment, each lacing part 10*a* includes two through holes 10*e* disposed on two ends thereof, respectively. The connecting part 10*b* includes through holes (not shown) correspondingly disposed on the surface thereof. The lacing part 10*a* and the connecting part 10*b* are in communication with each other via the through hole 10*e*, thereby allowing the air to flow between them. When the air is introduced into the inflatable shoelace 10, the inflatable shoelace 10 is inflated and expanded, as shown in FIG. 4C. With the three lacing parts 10*a* of the inflatable shoelace 10 to be inflated and inwardly compressed, it achieves the same tensioning effect as provided by the conventional shoelace. Since the inflatable shoelace 10 is an inflatable and expandable structure, the elasticity of the inflatable shoelace 10 is better and it avoids the uncomfortable feeling due to the poor elasticity when fastened as the conventional shoelace does. When the air is led out of the inflatable shoelace 10, the inflatable shoelace 10 is deflated and loosened to return to the initial state, as shown in FIG. 4A. With the three lacing parts 10*a* of the inflatable shoelace 10 to be deflated and loosened outwardly, it achieves the same unfastening effect as provided by the conventional shoelace and aids the user to wear or take off the sports shoe 2 easily. In addition, in the embodiment, the inflatable shoelace 10 is an artificial-muscle air-inflated shoelace, made of an electroactive polymer, such as the amino acid, which is a smart polymer material that can be controlled by the electric energy. The internal structure of the material can be stretched, bent, tightened or expanded, and has the bio-muscle-like elasticity and softness. By the properties of being inflatable, expandable or able to be tightened up, the artificial-muscle air-inflated shoelace provides the user with an excellent wearing experience of the sports shoe 2.

Figure 4D:
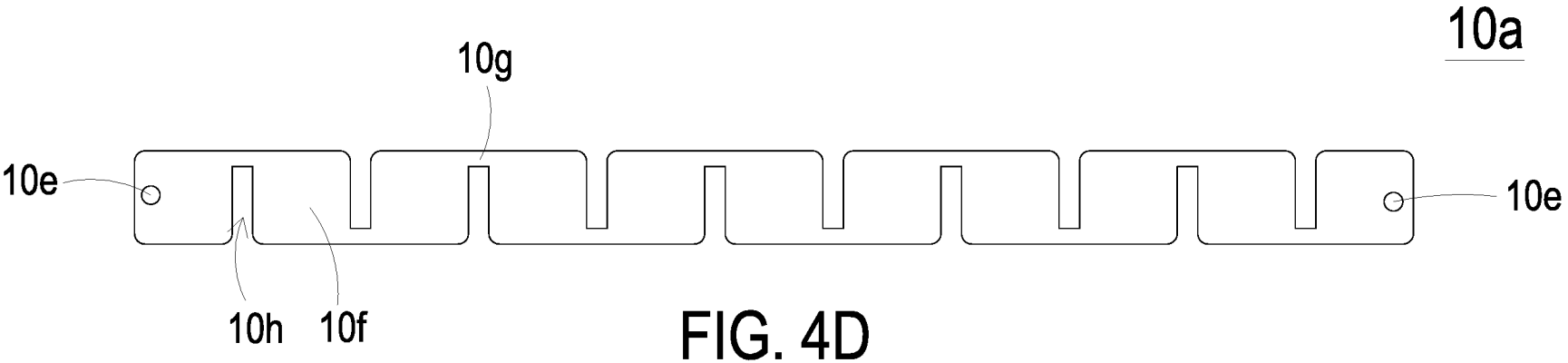
FIG. 4D schematically illustrates an inflatable shoelace in an initial status according to a second embodiment of the present disclosure.
Figure 4E:
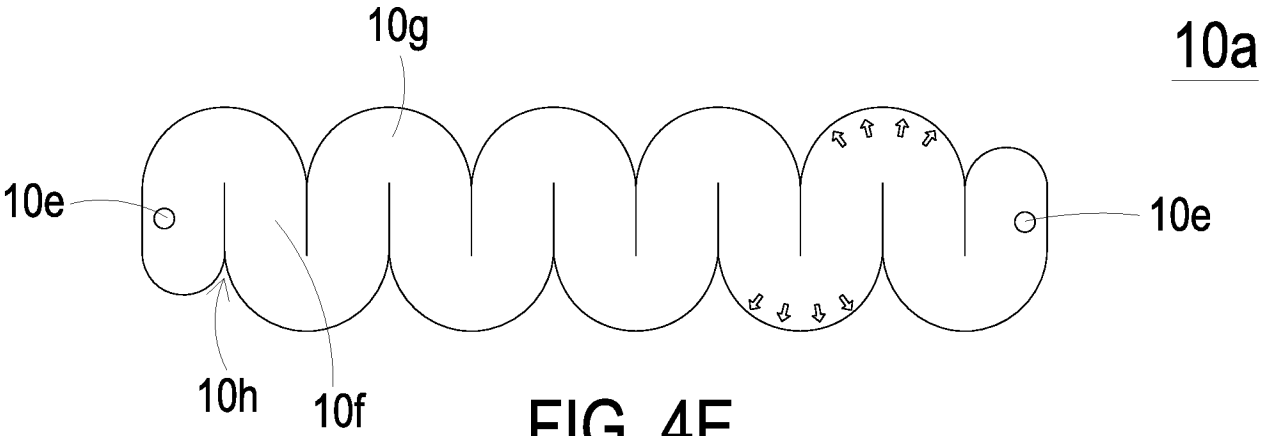
FIG. 4E schematically illustrates the inflatable shoelace of FIG. 4D to be inflated and expanded.

Please refer to FIGS. 4D and 4E. FIG. 4D schematically illustrates an inflatable shoelace in an initial status according to a second embodiment of the present disclosure. FIG. 4E schematically illustrates the inflatable shoelace of FIG. 4D to be inflated and expanded. As shown in FIG. 4D, in the second embodiment, the lacing part 10*a* of the inflatable shoelace 10 further includes plural expandable sections 10*f*, plural communication sections 10*g* and two through holes 10*e*. The plural communication sections 10*g* are disposed in an up-and-down staggered arrangement having plural communication sections 10*g* arranged alternately with each other without aligning on the same line. Each communication section 10*g* is connected between the two adjacent expandable sections 10*f*, and each gap 10*h* is defined between two adjacent expandable sections 10*f*, so that a strip-like shoelace structure with the plural "inverted S-shaped" links is formed, but not limited thereto. The two through holes 10*e* are disposed on two ends of the lacing part 10*a*, but not limited thereto. When the air is introduced into the inflatable shoelace 10 via the through holes 10*e*, the plural expandable sections 10*f* and the plural communication sections 10*g* are inflated and expanded and the plural gaps 10*h* are compressed to make the lacing part 10*a* inflated and inwardly compressed, as shown in FIG. 4E. It achieves the same tensioning effect as provided by the conventional shoelace, so as to fix and fit with the user's foot. Alternatively, when the air is led out of the inflatable shoelace 10, the lacing part 10*a* of the inflatable shoelace 10 is deflated and loosened to return to the initial state, as shown in FIG. 4D. With the lacing parts 10*a* to be deflated and loosened, it achieves the same unfastening effect as provided by the conventional shoelace and aids the user to wear or take off the sports shoe 2 easily.

Figure 4F:
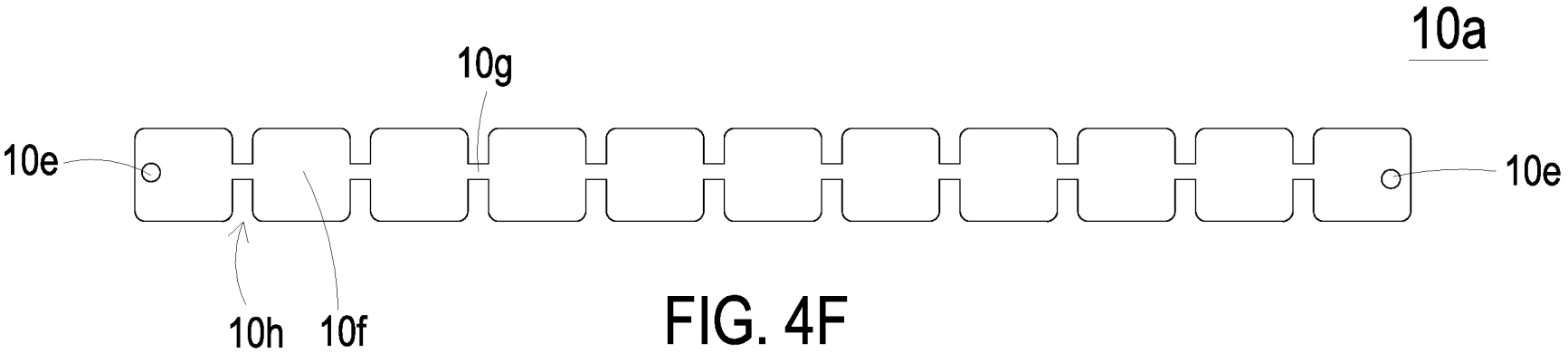
FIG. 4F schematically illustrates an inflatable shoelace in an initial status according to a third embodiment of the present disclosure.
Figure 4G:
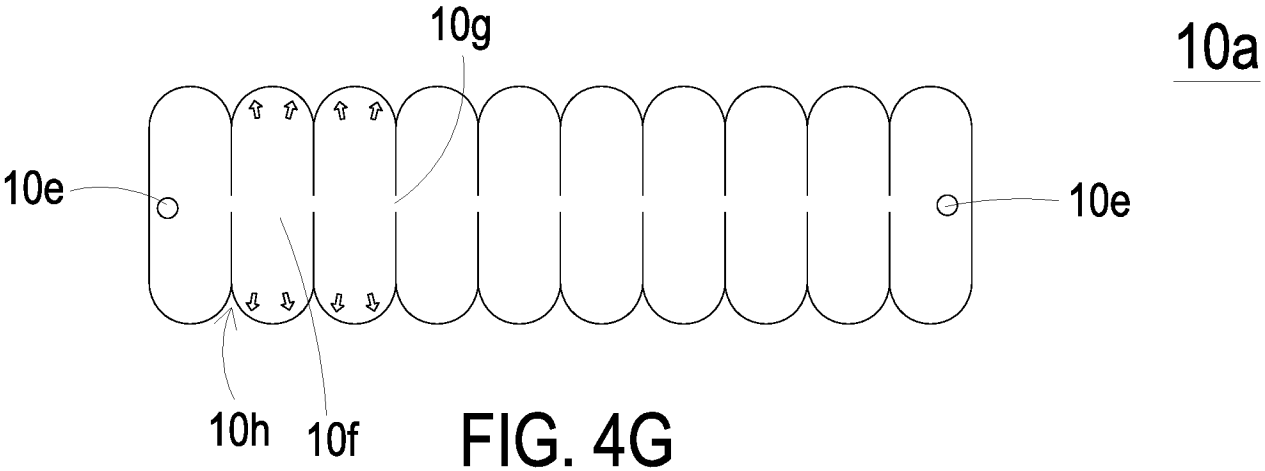
FIG. 4G schematically illustrates the inflatable shoelace of FIG. 4F to be inflated and expanded.

Please refer to FIGS. 4F and 4G. FIG. 4F schematically illustrates an inflatable shoelace in an initial status according to a third embodiment of the present disclosure. FIG. 4G schematically illustrates the inflatable shoelace of FIG. 4F to be inflated and expanded. As shown in FIG. 4F, in the third embodiment, the lacing part 10*a* of the inflatable shoelace 10 further includes plural expandable sections 10*f*, plural communication sections 10*g* and two through holes 10*e*. Each communication section 10*g* is connected between the two adjacent expandable sections 10*f*, and plural gaps 10*h* are defined between two adjacent expandable sections 10*f*, respectively, so that a strip-like shoelace structure is formed, but not limited thereto. The two through holes 10*e* are disposed on two ends of the lacing part 10*a*, but not limited thereto. When the air is introduced into the inflatable shoelace 10 via the through holes 10*e*, the plural expandable sections 10*f* and the plural communication sections 10*g* are inflated and expanded and the plural gaps 10*h* are compressed to make the lacing part 10*a* inflated and inwardly compressed, as shown in FIG. 4G. It achieves the same tensioning effect as provided by the conventional shoelace, so as to fix and fit with the user's foot. Alternatively, when the air is led out of the inflatable shoelace 10, the lacing part 10*a* of the inflatable shoelace 10 is deflated and loosened to return to the initial state, as shown in FIG. 4F. With the lacing parts 10*a* to be deflated and loosened, it achieves the same unfastening effect as provided by the conventional shoelace and aids the user to wear or take off the sports shoe 2 easily.

Figure 4H:
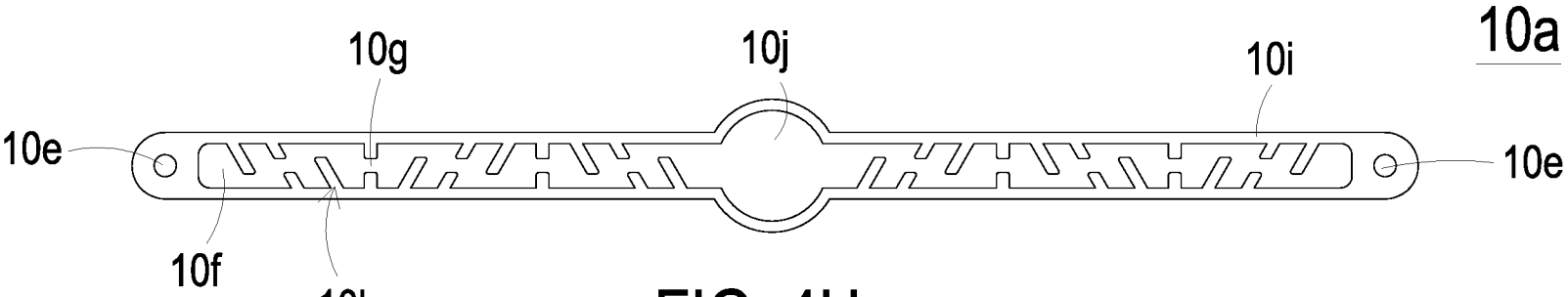
FIG. 4H schematically illustrates an inflatable shoelace in an initial status according to a fourth embodiment of the present disclosure.
Figure 4I:
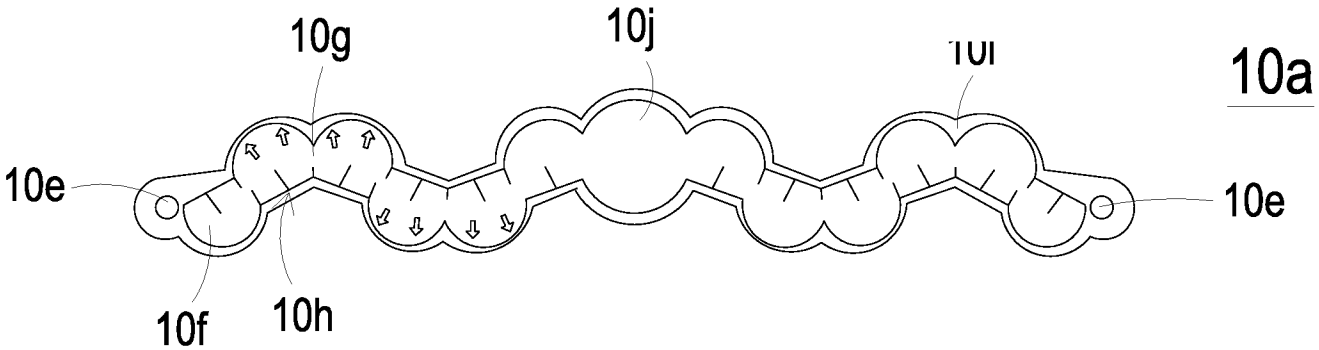
FIG. 4I schematically illustrates the inflatable shoelace of FIG. 4H to be inflated and expanded.

Please refer to FIGS. 4H and 4I. FIG. 4H schematically illustrates an inflatable shoelace in an initial status according to a fourth embodiment of the present disclosure. FIG. 4I schematically illustrates the inflatable shoelace of FIG. 4H to be inflated and expanded. As shown in FIG. 4H, in the fourth embodiment, the lacing part 10*a* of the inflatable shoelace 10 further includes two through holes 10*e*, plural expandable sections 10*f*, plural communication sections 10*g* and an outer portion 10*i*. The plural expandable sections 10*f* and the plural communication sections 10*g* are disposed in the outer portion 10*i*, and in communication with each other. The two through holes 10*e* are disposed on two ends of the outer portion 10*i*, and the plural expandable sections 10*f* disposed on two ends of the outer portion 10*i* are in communication with the two through holes 10*e* for the flow of the air. Each communication section 10*g* is connected between the two adjacent expandable sections 10*f*, and plural gaps 10*h* are defined between two adjacent expandable sections 10*f*, respectively, so that a strip-like shoelace structure is formed, but the present disclosure is not limited thereto. When the air is introduced into the inflatable shoelace 10 via the through holes 10*e*, the plural expandable sections 10*f* and the plural communication sections 10*g* are inflated and expanded and the plural gaps 10*h* are compressed to make the lacing part 10*a* inflated and inwardly compressed, as shown in FIG. 4I. It achieves the same tensioning effect as provided by the conventional shoelace, so as to fix and fit with the user's foot. Alternatively, when the air is led out of the inflatable shoelace 10, the lacing part 10*a* of the inflatable shoelace 10 is deflated and loosened to return to the initial state, as shown in FIG. 4H. With the lacing parts 10*a* to be deflated and loosened, it achieves the same unfastening effect as provided by the conventional shoelace and aids the user to wear or take off the sports shoe 2 easily. In some embodiments, the inflatable shoelace 10 can also be used alone to replace the shoelaces of the conventional footwear, and the lacing portion 10*a* of the inflatable shoelace 10 further includes an inlet nozzle 10*j*. The inlet nozzle 10*j* is also in communication with the expandable sections 10*f* through the communication sections 10*g* for connecting to an external pumping device, such as an air pump, an inflator and so on.

Figure 4J:
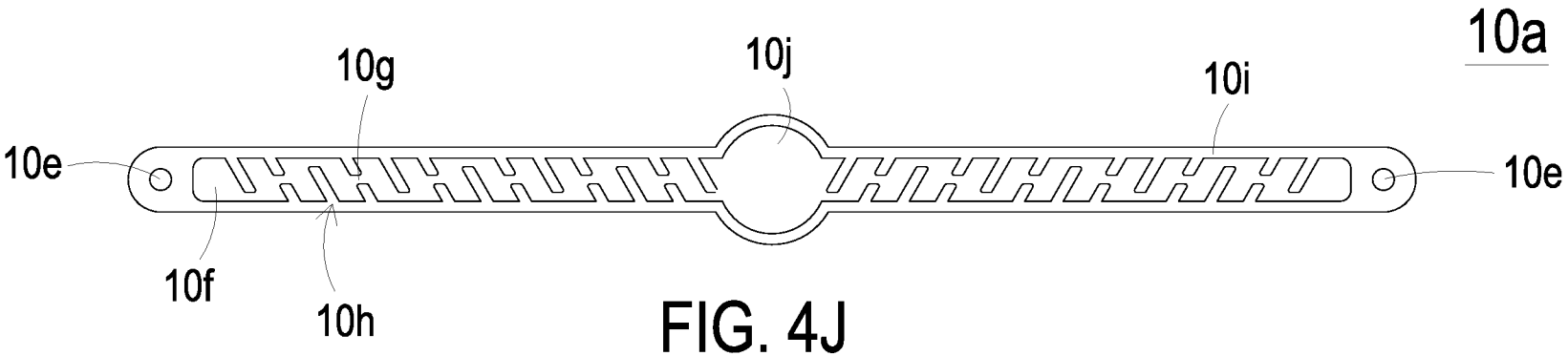
FIG. 4J schematically illustrates an inflatable shoelace in an initial status according to a fifth embodiment of the present disclosure.
Figure 4K:
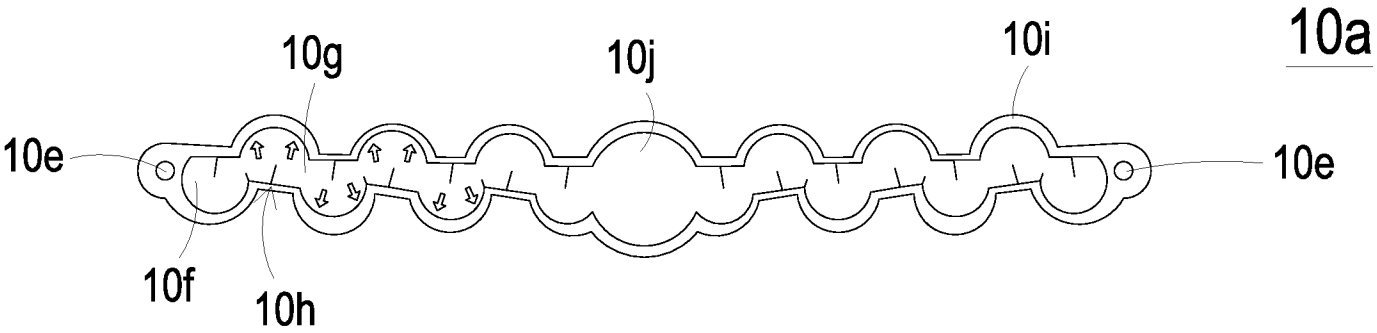
FIG. 4K schematically illustrates the inflatable shoelace of FIG. 4J to be inflated and expanded.

Please refer to FIGS. 4J and 4K. FIG. 4J schematically illustrates an inflatable shoelace in an initial status according to a fifth embodiment of the present disclosure. FIG. 4K schematically illustrates the inflatable shoelace of FIG. 4J to be inflated and expanded. As shown in FIG. 4J, in the fifth embodiment, the lacing part 10*a* of the inflatable shoelace 10 includes two through holes 10*e*, plural expandable sections 10*f*, plural communication sections 10*g* and an outer portion 10*i*. The plural expandable sections 10*f* and the plural communication sections 10*g* are disposed in the outer portion 10*i*, and in communication with each other. The two through holes 10*e* are disposed on two ends of the outer portion 10*i*, and the plural expandable sections 10*f* disposed on two ends of the outer portion 10*i* are in communication with the two through holes 10*e* for the flow of the air. Each communication section 10*g* is connected between the two adjacent expandable sections 10*f*, and plural gaps 10*h* are defined between two adjacent expandable sections 10*f*, respectively, so that a strip-like shoelace structure is formed, but the present disclosure is not limited thereto. When the air is introduced into the inflatable shoelace 10, the lacing part 10*a* of the inflatable shoelace 10 is inflated and expanded, and the plural expandable sections 10*f* and the plural communication sections 10*g* of the inflatable shoelace 10 are inflated and expanded and the plural gaps 10*h* are compressed to make the lacing part 10*a* inflated and inwardly compressed, as shown in FIG. 4K. It achieves the same tensioning effect as provided by the conventional shoelace, so as to fix and fit with the user's foot. Alternatively, when the air is led out of the inflatable shoelace 10, the lacing part 10*a* of the inflatable shoelace 10 is deflated and loosened to return to the initial state, as shown in FIG. 4J. With the lacing parts 10*a* to be deflated and loosened, it achieves the same unfastening effect as provided by the conventional shoelace and aids the user to wear or take off the sports shoe 2 easily. In some embodiments, the inflatable shoelace 10 can also be used alone to replace the shoelaces of the conventional footwear, and the lacing portion 10*a* of the inflatable shoelace 10 further includes an inlet nozzle 10*j*. The inlet nozzle 10*j* is also in communication with the communication sections 10*g* for connecting to an external pumping device, such as an air pump, an inflator and so on.

Figure 5A:
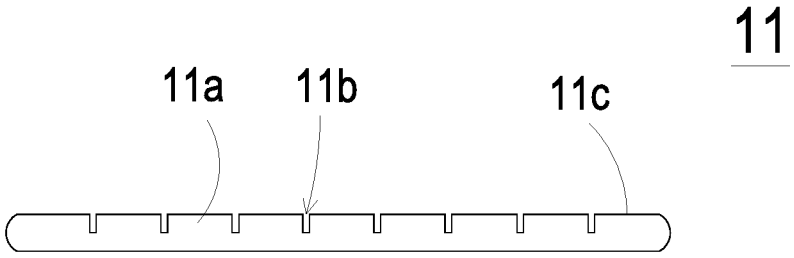
FIG. 5A is a cross-sectional view illustrating the inflatable shoe tongue of FIG. 2 in an inflated and expanded status and taken along the line AA.
Figure 5B:
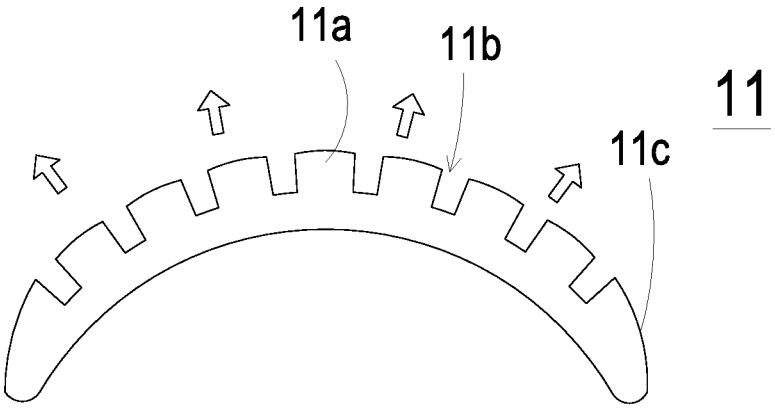
FIG. 5B schematically illustrates the inflatable shoe tongue of FIG. 5A in an initial status.

Please refer to FIGS. 2, 5A and 5B. FIG. 5A is a cross-sectional view illustrating the inflatable shoe tongue of FIG. 2 in an inflated and expanded status and taken along the line AA. FIG. 5B schematically illustrates the inflatable shoe tongue of FIG. 5A in an initial status. As shown in FIG. 2, in this embodiment, the inflatable shoe tongue 11 is an inflatable and expandable structure with the air, and connected with the shoe body 21. The inflatable shoe tongue 11 is disposed and spatially corresponding to the user's instep, but not limited thereto. As shown in FIG. 5A, the inflatable shoe tongue 11 includes an outer surface 11*c* having plural protrusions 11*a*. Each two adjacent protrusions 11*a* includes a gap 11*b* disposed therebetween. When the air is introduced into the inflatable shoe tongue 11, the inflatable shoe tongue 11 is inflated and expanded. With the plural protrusions 11*a* on the outer surface 11*c* to be expanded to protrude outwardly, it makes the inflatable shoe tongue 11 to protrude and bulge in a second direction away from the wear space 23 and the opening 24 is enlarged, so as to aid the user to wear or take off the sports shoe 2 easily. Afterward, as shown in FIG. 5B, when the air is led out of the inflatable shoe tongue 11, the inflatable shoe tongue 11 is deflated and compressed inwardly. With the plural protrusions 11*a* on the outer surface 11*c* to be compressed inwardly, it make the inflatable shoe tongue 11 to shrink in a first direction toward the wear space 23 to return to the initial statue as shown in FIG. 5B. Thus, the user's foot is fixed in the sports shoe 2 firmly.

Figure 6A:
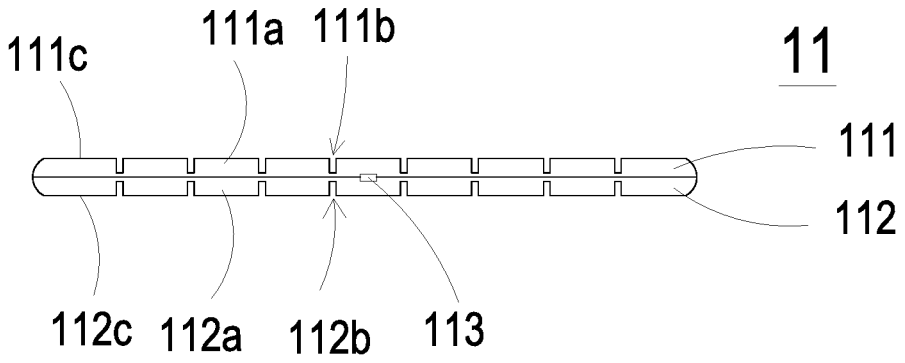
FIG. 6A is a cross-sectional view illustrating the inflatable shoe tongue according to another preferred embodiment of the present disclosure.
Figure 6B:
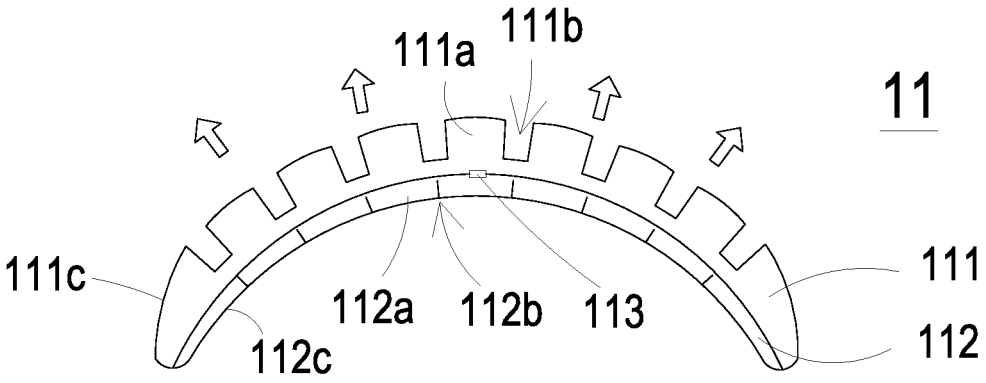
FIG. 6B schematically illustrates an outer airbag of the inflatable shoe tongue of FIG. 6A in an inflated and expanded status.
Figure 6C:
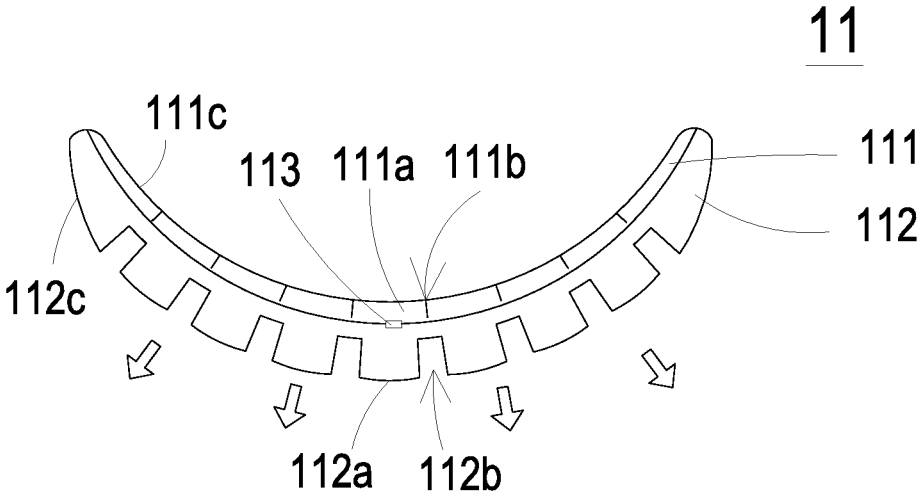
FIG. 6C schematically illustrates an inner airbag of the inflatable shoe tongue of FIG. 6A in an inflated and expanded status.

Please refer to FIGS. 6A to 6C. FIG. 6A is a cross-sectional view illustrating the inflatable shoe tongue according to another preferred embodiment of the present disclosure. FIG. 6B schematically illustrates an outer airbag of the inflatable shoe tongue of FIG. 6A in an inflated and expanded status. FIG. 6C schematically illustrates an inner airbag of the inflatable shoe tongue of FIG. 6A in an inflated and expanded status. As shown in FIGS. 6A to 6C, in another embodiment, the inflatable shoe tongue 11 includes an outer airbag 111, an inner airbag 112 and a two-way valve 113. The outer airbag 111 includes an outer surface 111*c* having plural protrusions 111*a* protruding outwardly, and a gap 111*b* is disposed between each two adjacent protrusions 111*a* of the outer airbag 111. The inner airbag 112 includes an inner surface 112*c* having plural protrusions 112*a* protruding inwardly, and a gap 112*b* is disposed between each two adjacent protrusion 112*a* of the inner airbag 112. The two-way valve 113 is a two-way air intake structure and in communication between the outer airbag 111 and the inner airbag 112. The two-way valve 113 is electrically connected with the control module 15. With the two-way valve 113 to introduce the air into the plural protrusions 111*a* of the outer airbag 111, it makes the outer airbag 111 expanded in the second direction to protrude outwardly to move the inflatable shoe tongue 11 away from the wear space 23, and the opening 24 is expanded, so as to aid the user to wear or take off the sports shoe 2 easily. Alternatively, with the two-way valve 113 to introduce the air into the plural protrusions 112*a* of the inner airbag 112, it make the inner airbag 112 expanded in the first direction to protrude inwardly to move the inflatable shoe tongue 11 toward the wear space 23, and the opening 24 and the wear space 23 are shrunk inwardly, so as to aid the user's foot to be fixed in the sports shoe 2 firmly. Therefore, with the configuration of the outer airbag 111, the inner airbag 112 and the two-way valve 113, the inflatable shoe tongue 11 can be controlled to protrude inwardly or outwardly, and the effects of fastening and loosening can be achieved by using the inflatable shoe tongue 11 of the pressure fixing device 1 without the shoelaces.

Figure 7A:
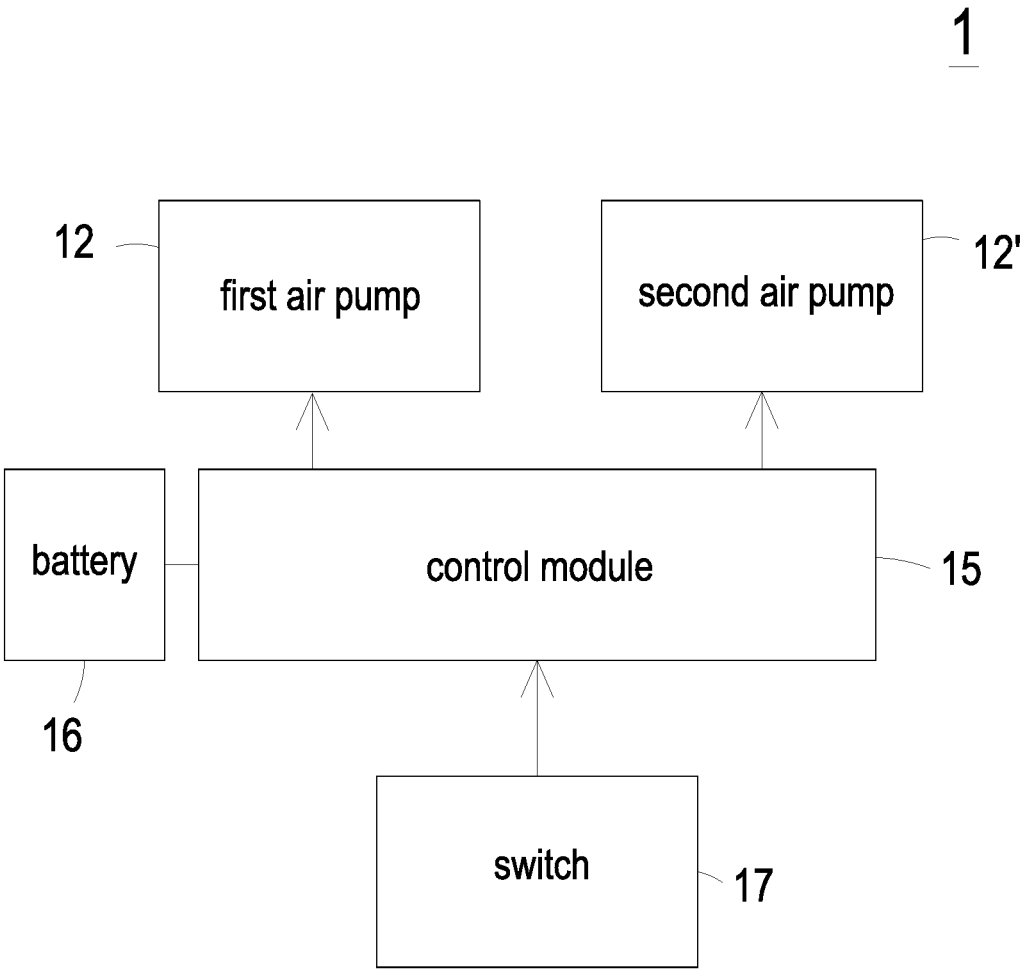
FIG. 7A schematically illustrates the structure of the pressure fixing device applied to the shoe according to the preferred embodiment of the present disclosure.
Figure 7B:
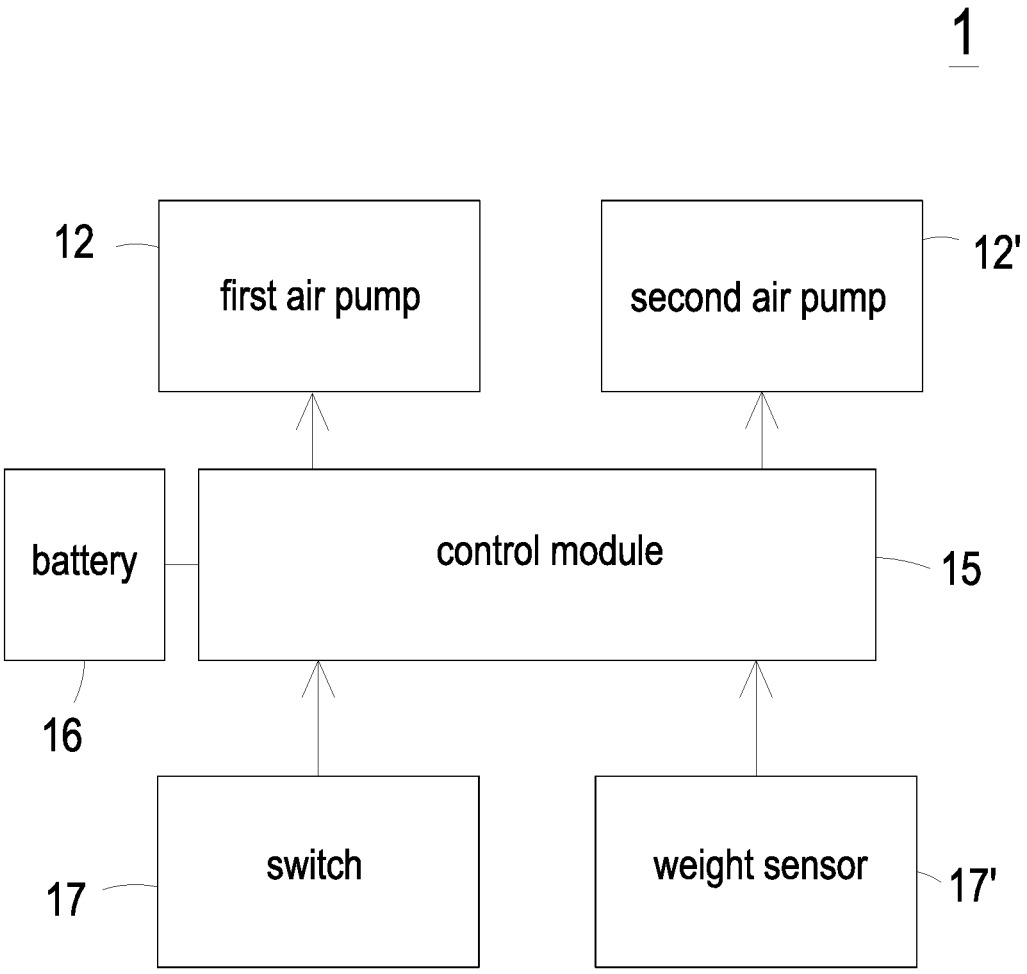
FIG. 7B schematically illustrates the structure of the pressure fixing device applied to the shoe according to another preferred embodiment of the present disclosure.
Figure 8:
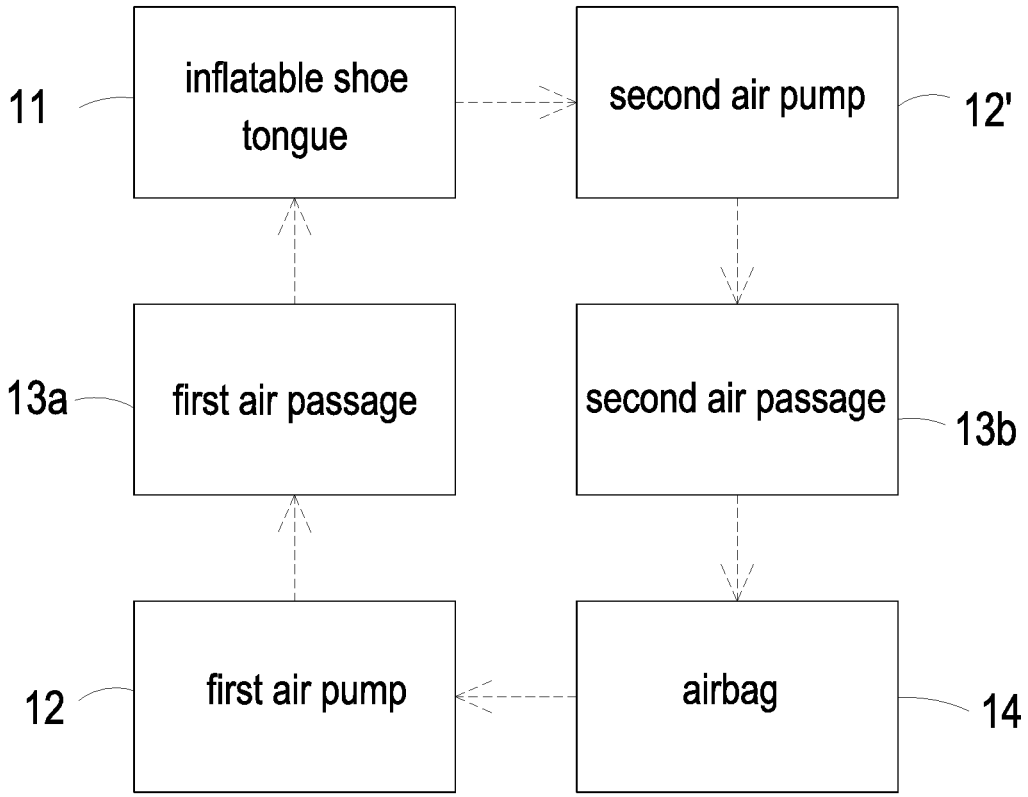
FIG. 8 schematically illustrates the flow of the air in the pressure fixing device according to the preferred embodiment of the present disclosure.
Figure 9A:
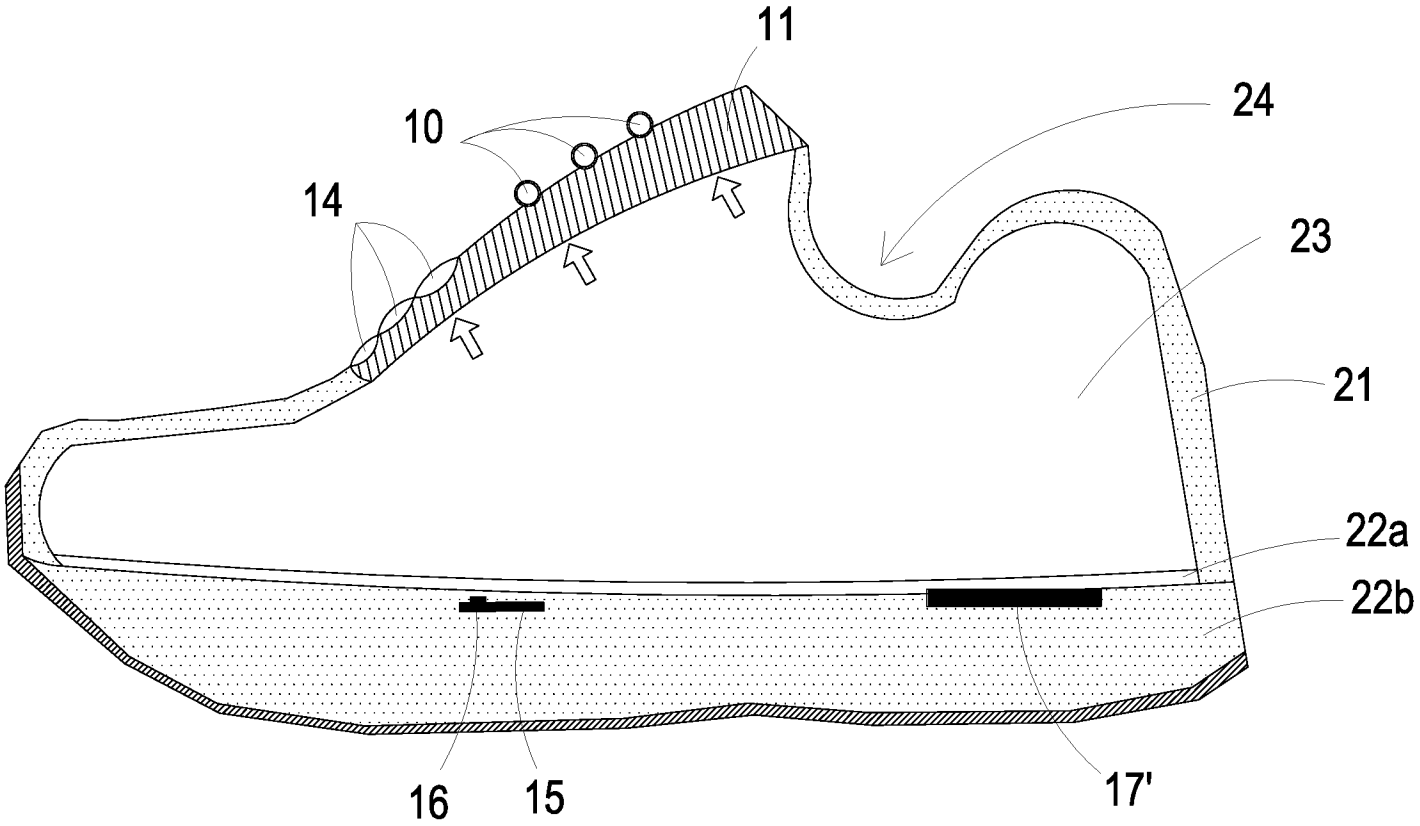
FIG. 9A is a cross-sectional view illustrating the shoe in an initial status according to the preferred embodiment of the present disclosure.
Figure 9B:
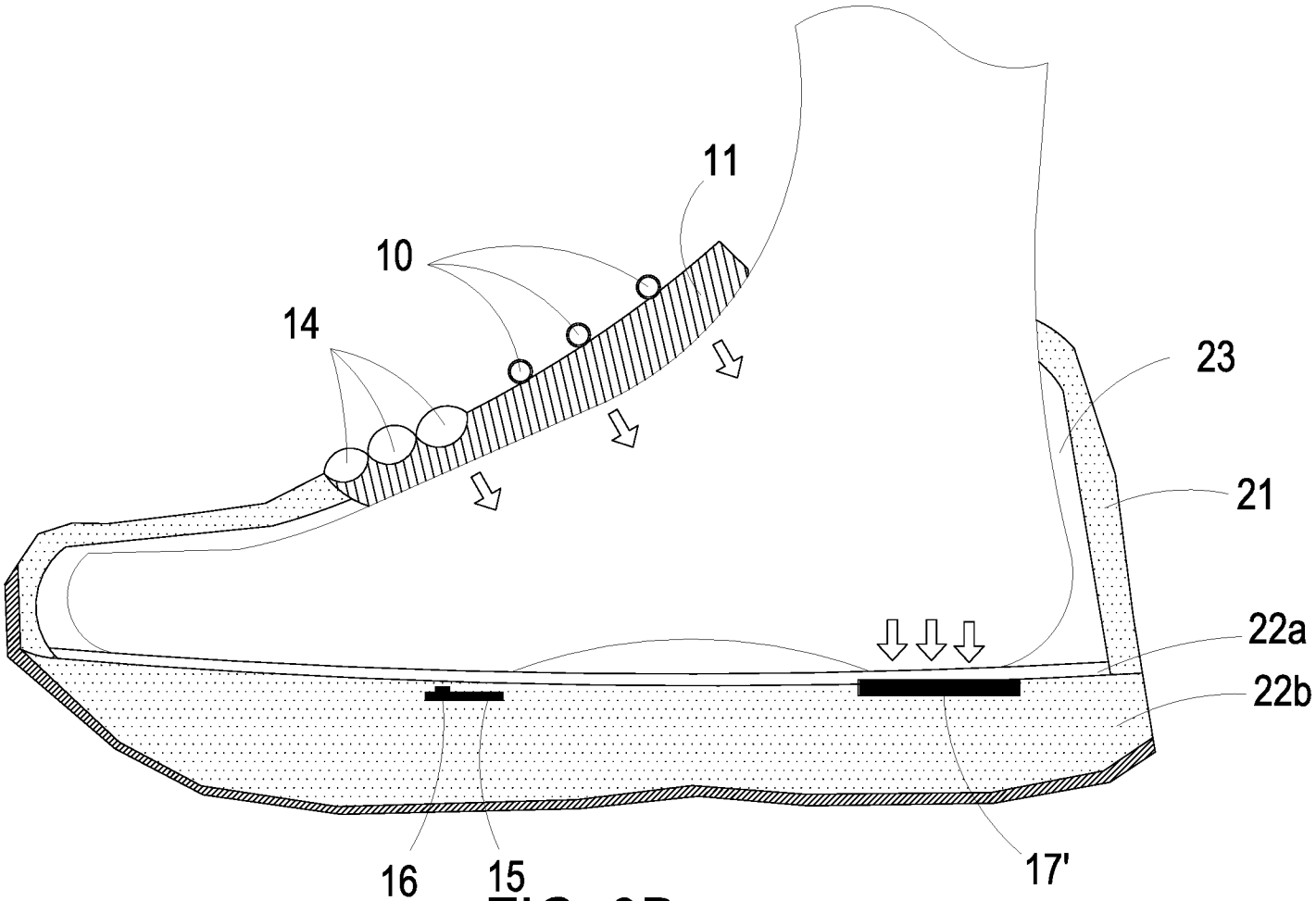
FIG. 9B is a cross-sectional view illustrating the shoe in a wearing status according to the preferred embodiment of the present disclosure.

Please refer to FIGS. 7A, 8, 9A and 9B. FIG. 7A schematically illustrates the structure of the pressure fixing device applied to the shoe according to the preferred embodiment of the present disclosure. FIG. 8 schematically illustrates the flow of the air in the pressure fixing device according to the preferred embodiment of the present disclosure. FIG. 9A is a cross-sectional view illustrating the shoe in an initial status according to the preferred embodiment of the present disclosure. FIG. 9B is a cross-sectional view illustrating the shoe in a wearing status according to the preferred embodiment of the present disclosure. As shown in FIG. 7A, the pressure fixing device 1 further includes a switch 17. The switch 17 is electrically connected to the control module 15. The switch 17 is provided for the user to control the pressure fixing device 1. For describing the specific implementation, please refer to FIGS. 7A to 9B. When the user's foot is inserted into the wear space 23 of the sports shoe 2, the user turns on the switch 17 and the switch 17 sends the second enabling signal to the control module 15, so that the control module 15 enables the second air pump 12' to operate according the second enabling signal. Consequently, the air is introduced from the inflatable shoe tongue 11 and the airbag 14 into the inflatable shoelace 10, the inflatable shoe tongue 10 shrinks in the first direction and moves toward the wear space 23 and the inflatable shoelace 10 is expanded and tighten to attach to the user's instep. Alternatively, when the user's foot has to get out of the sports shoe 2, the user turns off the switch 17 and the switch 17 sends a first enabling signal to the control module 15, so that the control module 15 enables the first air pump 12 to operate according to the first enabling signal. Consequently, the air is introduced from the inflatable shoelace 10 into the inflatable shoe tongue 11 and the airbag 14, the inflatable shoelace 10 is deflated and loosened, and the inflatable shoe tongue 11 is expanded due to the air inflated and protrudes away from the wear space 23. Meanwhile, the inflatable shoe tongue 11 has an end adjacent to the airbag 14 to be pressed and another end to be lifted, so that the opening 24 collaboratively defined by the inflatable shoe tongue 11 and the shoe body 21 is expanded. It aids the user to wear or take off the sports shoe 2 easily (as shown in FIG. 9A). In addition, the switch 17 is this embodiment can be disposed in the shoe body 21 (not shown), but not limited thereto.

Moreover, please refer to FIG. 7B. FIG. 7B schematically illustrates the structure of the pressure fixing device applied to the shoe according to another preferred embodiment of the present disclosure. As shown in FIG. 7B, the pressure fixing device 1 further includes a weight sensor 17'. The weight sensor 17' is electrically connected to the control module 15. In the embodiment, the weight sensor 17' can be disposed in the bottom part 22 of the sports shoe 2, but not limited thereto. When the user's foot is inserted into and received in the wear space 23 of the sports shoe 2 and the weight sensor 17' detects a pressing force, the weight sensor 17' sends the second enabling signal to the control module 15 and the control module 15 enables the second air pump 12' to operate according the second enabling signal. Consequently, the air is introduced from the inflatable shoe tongue 11 into the inflatable shoelace 10, the inflatable shoe tongue 11 shrinks in the first direction and moves toward the wear space 23 and the inflatable shoelace 10 is expanded and tighten to attach to the user's instep. After the user's foot is accommodated in the sports shoe 2, the inflatable shoelace 10 of the sports shoe 2 is inflated and pressed inwardly to achieve the effect of automatic fixing.

In the embodiment, the pressure fixing device 1 further includes a first air pressure sensor (not show). The first air pressure sensor is disposed within the inflatable shoe tongue 11 and electrically connected with the control module 15. When the first air pressure sensor detects that the inflatable shoe tongue 11 has an internal pressure higher than a specific threshold interval, the first air pressure sensor sends a first disabling signal to the control module 15 and the control module 15 disables the first air pump 12 to stop operating according to the first disabling signal. Thus, it prevents the inflatable shoe tongue 11 from getting broken caused by the excessive pressure, and prevents the first air pump 12 from reducing its service life caused by the continuous operation for a long time. Moreover, in the embodiment, the pressure fixing device 1 further includes a second air pressure sensor (not shown). The second air pressure sensor is disposed within the inflatable shoelace 10 and electrically connected to the control module 15. When the second air pressure sensor detects that the inflatable shoelace 10 has an internal pressure higher than the specific threshold interval, the second air pressure sensor sends a second disabling signal to the control module 15 and the control module 15 disables the second air pump 12' to stop operating according to the second disabling signal. Thus, it prevents the inflatable shoelace 10 from getting broken caused by the excessive pressure, and prevents the second air pump 12' from reducing the service life caused by the continuous operation for a long time. In addition, the pressure fixing device 1 further includes an inlet valve (not shown) embedded in the outer surface 11*c* of the inflatable shoe tongue 11 and electrically connected to the control module 15. When the first air pressure sensor or the second air pressure sensor detects that the internal pressure of the inflatable shoelace 10 or the inflatable shoe tongue 11 is lower than the specific threshold interval, the first air pressure sensor or the second air pressure sensor sends a gas-filling signal to the control module 15 and the control module 15 drives the inlet valve according to the gas-filling signal to introduce the air from outside into the inflatable shoe tongue 11 of the pressure fixing device 1. Thus, it prevents the inner pressure of the inflatable shoelace 10 or the inflatable shoe tongue 11 from being too low to achieve the fixing effect.

In other embodiments, the inflatable shoelace 10 of the pressure fixing device 1 can be replaced by the conventional shoelace, and the pressure fixing device 1 can achieve the effect of fixing or unfastening by using the inflatable shoe tongue 11 merely. In such one embodiment, the first air pump 12 and the second air pump 12' are in communication between the outside of the pressure fixing device 1 and the inflatable shoe tongue 11. With the first air pump 12 to lead the air out of the inflatable shoe tongue 11 and the airbag 14 of the pressure fixing device 1, the inflatable shoe tongue 11 is shrunk toward the wear space 23 to fit with the user's foot. Alternatively, with the second air pump 12' to introduce the air from the outside into the inflatable shoe tongue 11 and the airbag 14, the inflatable shoe tongue 11 is expanded due to the inflated air and protrudes in the second direction away from the wear space 23 to enlarge the opening 24, thereby aiding the user to wear the sports shoe 2 easily.

Figure 10A:
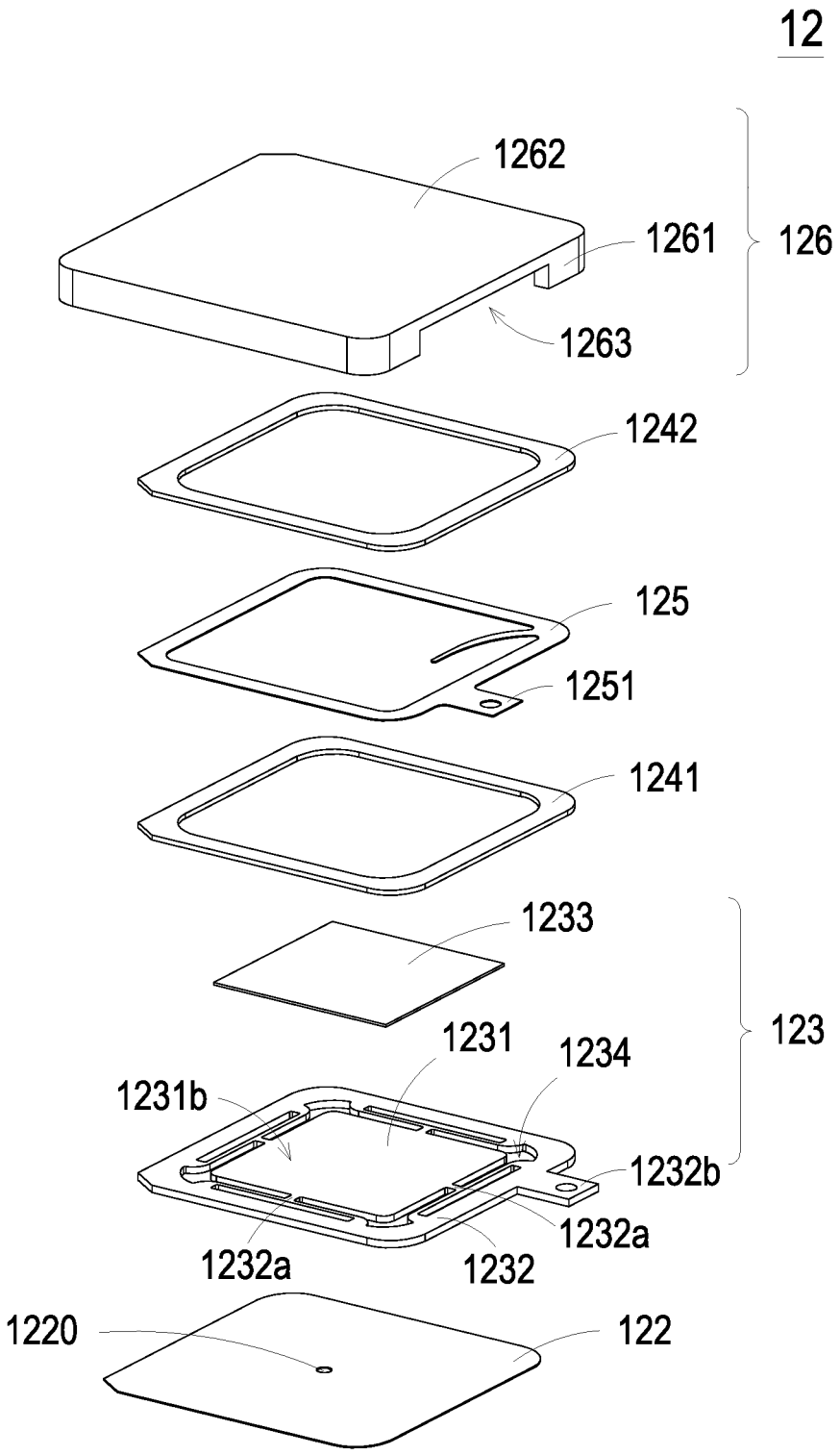
FIG. 10A is a front exploded view illustrating the air pump according to a preferred embodiment of the present disclosure.
Figure 10B:
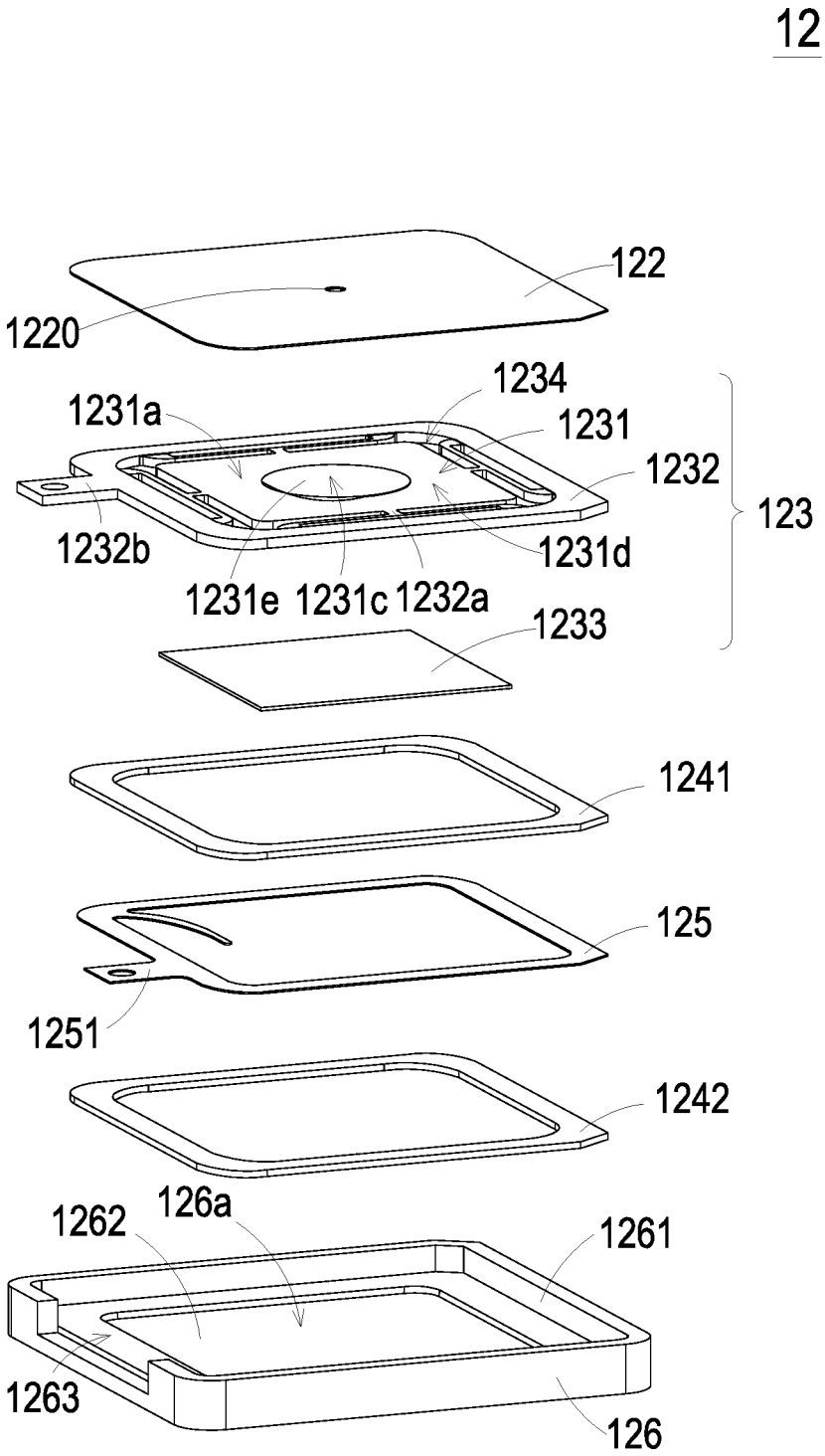
FIG. 10B is a rear exploded view illustrating the air pump according to the preferred embodiment of the present disclosure.

Please refer to FIGS. 10A and 10B. FIG. 10A is a front exploded view illustrating the air pump according to a preferred embodiment of the present disclosure. FIG. 10B is a rear exploded view illustrating the air pump according to the preferred embodiment of the present disclosure. In the embodiment, the first air pump 12 is a piezoelectric air pump for driving the flow of the air. As shown in FIGS. 10A and 10B, the first air pump 12 of the present disclosure includes a resonance plate 122, a piezoelectric actuator 123 and the cover plate 126. The resonance plate 122 is disposed spatially corresponding to the piezoelectric actuator 123. The resonance plate 122 includes a central aperture 1220 and a movable part (not shown). The central aperture 1220 is disposed on the central area of the resonance plate 122, but not limited thereto. The movable part is disposed around the central aperture 1220, so that the movable part of the resonance plate is reciprocated along with the piezoelectric actuator to generate a resonance air flowing. The piezoelectric actuator 123 includes a suspension plate 1231, an outer frame 1232 and a piezoelectric element 1233. The suspension plate 1231 can be but not limited to a square suspension plate with a bulge 1231*e*. The suspension plate 1231 includes a central portion 1231*c* and a peripheral portion 1231*d*. When a voltage is applied to the piezoelectric element 1233, the suspension plate 1231 is subjected to a bending vibration from the central portion 1231*c* to the peripheral portion 1231*d*. The outer frame 1232 is arranged outside around the suspension plate 1231 and includes at least one bracket 1232*a* and a conducting pin 1232*b*, but not limited thereto. Each bracket 1232*a* includes two ends connected between the suspension plate 1231 and the outer frame 1232 for providing an elastically supporting. The conducting pin 1232*b* protrudes outwardly from the outer frame 1232 for an electrically external connection. The piezoelectric element 1233 is attached to a second surface 1231*b* of the suspension plate 1231. The length of a side of the piezoelectric element 1233 is equal to or less than the length of a side of the suspension plate 1231, so as to receive the applied voltage and generate the deformation to drive the bending vibration of the suspension plate 1231. The cover plate 126 includes at least one sidewall 1261, a bottom plate 1262 and an opening portion 1263. The sidewalls 1261 surrounds and protrudes vertically from a periphery of the bottom plate 1262, so as to define an accommodation space 126*a* by the sidewalls 1261 and the bottom plate 1262 collaboratively. The resonance plate 122 and the piezoelectric actuator 123 are accommodated within the accommodation space 126*a*. The opening portion 1263 is disposed on the sidewall 1261 so that the conducting pin 1232*b* of the outer frame 1232 passes through the opening portion 1263 and protrudes out of the cover plate 126. It's beneficial for the conducting pin 1232*b* to connect with an external power, but the present disclosure is not limited thereto.

In the embodiment, the first air pump 12 of the present disclosure further includes a first insulation plate 1241, a second insulation plate 1242 and a conducting plate 125, but not limited thereto. The first insulation plate 1241 and the second insulation plate 1242 are disposed on the top and the bottom of the conducting plate 125, respectively, and have the profiles substantially matching the profile of the outer frame 1232 of the piezoelectric actuator 123. The first insulation plate 1241 and the second insulation plate 1242 can be made of an insulating material, for example but not limited to a plastic material, for providing insulating efficacy. The conducting plate 125 is made of an electrically conductive material, for example but not limited to a metallic material, for providing electrically conducting efficacy. The conducting plate 125 has its profile substantially matching the profile of the outer frame 1232 of the piezoelectric actuator 123, but the present disclosure is not limited thereto. Moreover, the conducting plate 125 may have a conducting pin 1251 for an electrically external conduction. The conducting pin 1251 is similar to the conducting pin 1232*b* of the outer frame 1232 to pass through the opening portion 1263 and protrude out of the cover plate 126 for electrically connecting to the control module 15.

Figure 11A:
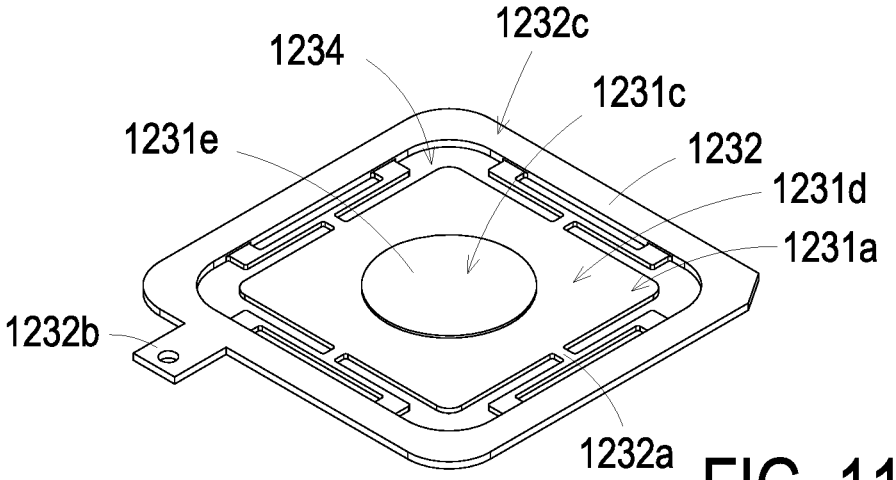
FIG. 11A is a front view illustrating the piezoelectric actuator of FIGS. 10A and 10B.
Figure 11B:
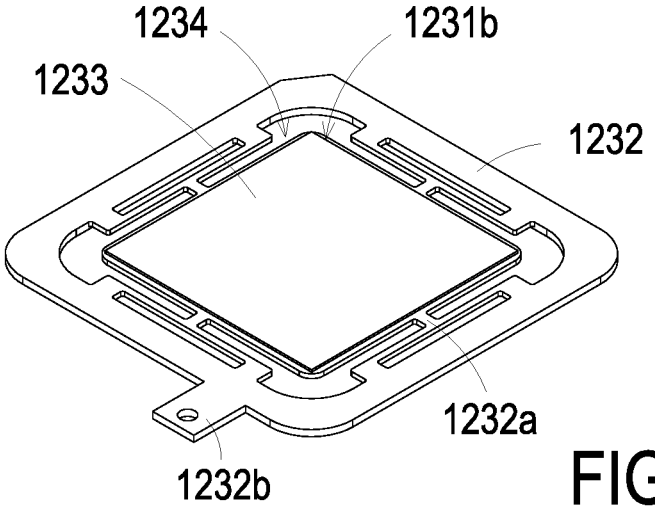
FIG. 11B is a rear view illustrating the piezoelectric actuator of FIGS. 10A and 10B.
Figure 11C:
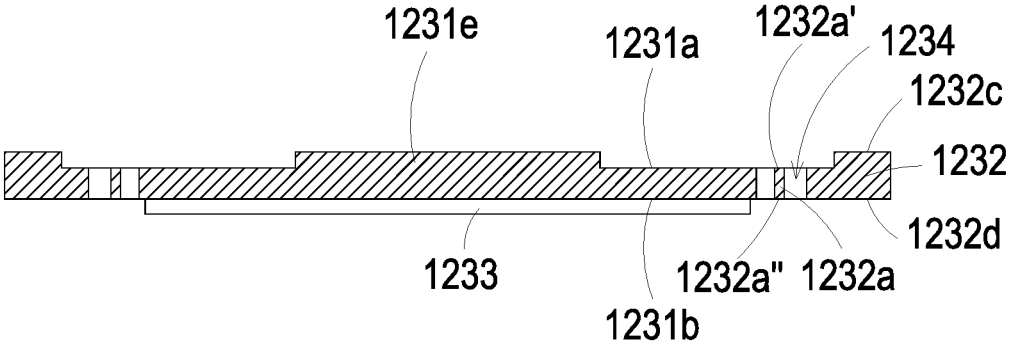
FIG. 11C is a cross-sectional view illustrating the piezoelectric actuator of FIGS. 10A and 10B.

Please refer to FIGS. 11A to 11C. FIG. 11A is a front view illustrating the piezoelectric actuator of FIGS. 10A and 10B. FIG. 11B is a rear view illustrating the piezoelectric actuator of FIGS. 10A and 10B. FIG. 11C is a cross-sectional view illustrating the piezoelectric actuator of FIGS. 10A and 10B. As shown in FIGS. 11A to 11C, in the embodiment, the suspension plate 1231 has a stepped structure. The suspension plate 1231 further includes a bulge 1231*e* disposed on the central portion 1231*c* of the first surface 1231*a*. The bulge 1231*e* can be a circular protrusion structure, but not limited thereto. In some embodiment, the suspension plate 1231 can be a double-sided planar square plate. Further as shown in FIG. 11C, the bulge 1231*e* of the suspension plate 1231 and the first surface 1232*c* of the outer frame 1232 are coplanar, and the first surface 1231*a* of the suspension plate 1231 and the first surface 1232*a*' of the bracket 1232*a* are coplanar. In addition, the bulge 1231*e* of the suspension plate 1231 and the first surface 1232*c* of the outer frame 1232 have a specific depth relative to the first surface 1231*a* of the suspension plate 1231 and the first surface 1232*a*' of the bracket 1232*a*. As shown in FIGS. 11B and 11C, the second surface 1231*b* of the suspension plate 1231, the second surface 1232*d* of the outer frame 1232 and the second surface 1232*a*" of the bracket 1232*a* are formed as a flat coplanar structure. The piezoelectric element 1233 is attached to the flat second surface 1231*b* of the suspension plate 1231. In some embodiments, the suspension plate 1231 can be a double-sided planar square plate, but not limited thereto. It is adjustable according to the practical requirements. In some embodiment, the suspension plate 1231, the outer frame 1232 and the bracket 1232*a* can be formed as an integrated structure, and made of a metal plate, for example but not limited to a stainless steel plate. Moreover, in the embodiment, the first air pump 12 further includes at least one interspace 1234 disposed among the suspension plate 1231, the outer frame 1232 and the bracket 1232*a* for the air passing therethrough.

Figure 12:
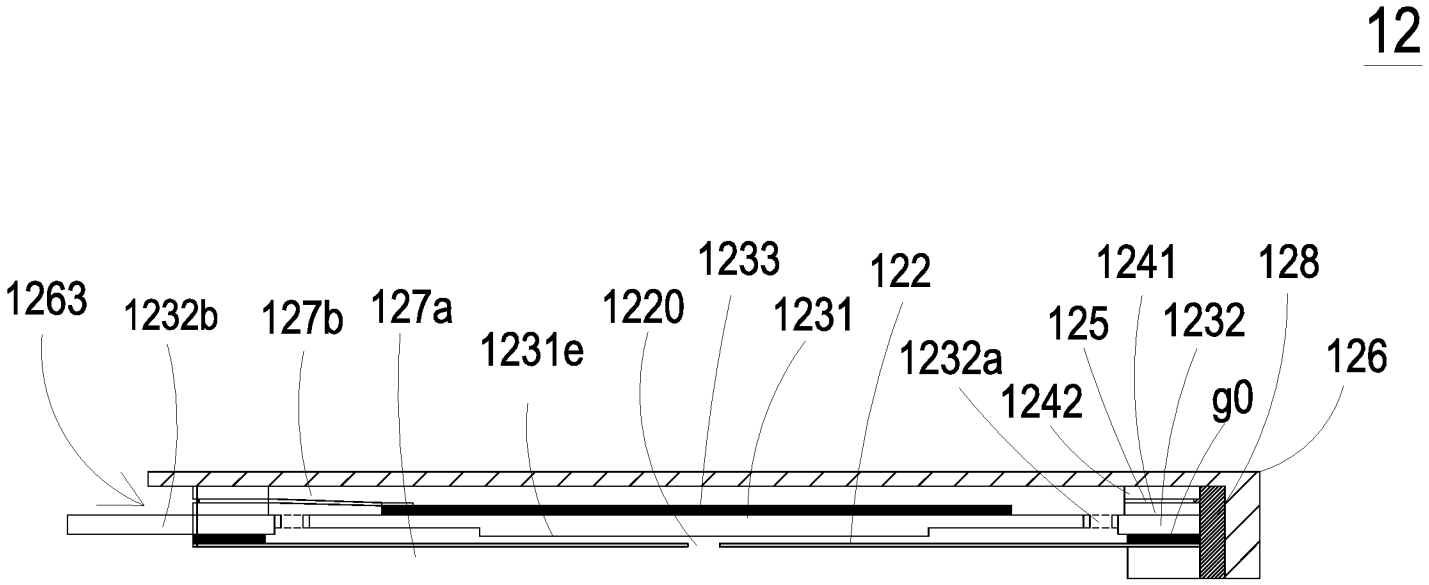
FIG. 12 is a cross-sectional view illustrating the air pump of FIGS. 10A and 10B.

Please refer to FIG. 12. FIG. 12 is a cross-sectional view illustrating the air pump of FIGS. 10A and 10B. As shown in FIG. 12, the first air pump 12 includes the cover plate 126, the second insulation plate 1242, the conducting plate 125, the first insulation plate 1241, the piezoelectric actuator 123 and the resonance plate 122 stacked on each other from top to bottom sequentially. After the piezoelectric actuator 123, the first insulation plate 1241, the conducting plate 125 and the second insulation plate 1242 are assembled and stacked, an adhesive 128 is coated around the periphery of the assembled structure to accomplish sealing. The assembled first air pump 12 is a quadrilateral structure, but not limited thereto. The shape can be adjustable according to the practical requirements. In addition, in the embodiment, the conducting pin 1251 of the conducting plate 125 and the conducting pin 1232*b* (shown in FIG. 10A) of the piezoelectric actuator 123 protrude out of the cover plate 126 merely for electrically connecting with an external power, but not limited thereto. The first chamber 127*b* is formed between the cover plate 126 and the resonance plate 122 in the assembled first air pump 12.

In the embodiment, the first air pump 12 of the present disclosure includes a gap g0 disposed between the resonance plate 122 and the piezoelectric actuator 123, and a conductive material, for example but not limited to a conductive adhesive, is filled into the gap g0. Consequently, the depth of the gap g0 between the resonance plate 122 and the bulge 1231*e* of the suspension plate 1231 of the piezoelectric actuator 123 is maintained, which is capable of guiding the air to flow more quickly. Moreover, due to the proper distance between the bulge 1231*e* of the suspension plate 1231 and the resonance plate 122, the contact interference is reduced and thus the generated noise is largely reduced. In other embodiments, by adding the height of the outer frame 1232 of the piezoelectric actuator 123, a gap is added when the outer frame 1232 is assembled with the resonance plate 122, but the present disclosure is not limited thereto. Thus, when the piezoelectric actuator 123 is driven to converge the air, the air is transferred from the opening portion 1263 of the cover plate 126 to the convergence chamber 127*a*, and then temporarily stored in the first chamber 127*b* through the central aperture 1220 of the resonance plate 122. When the piezoelectric actuator 123 is driven to discharge the air, the air is transferred from the first chamber 127*b* to the convergence chamber 127*a* through the central aperture 1220 of the resonance plate 122, and introduced into the inflatable shoe tongue 11 through the inflatable shoelace 10.

Figure 13A:
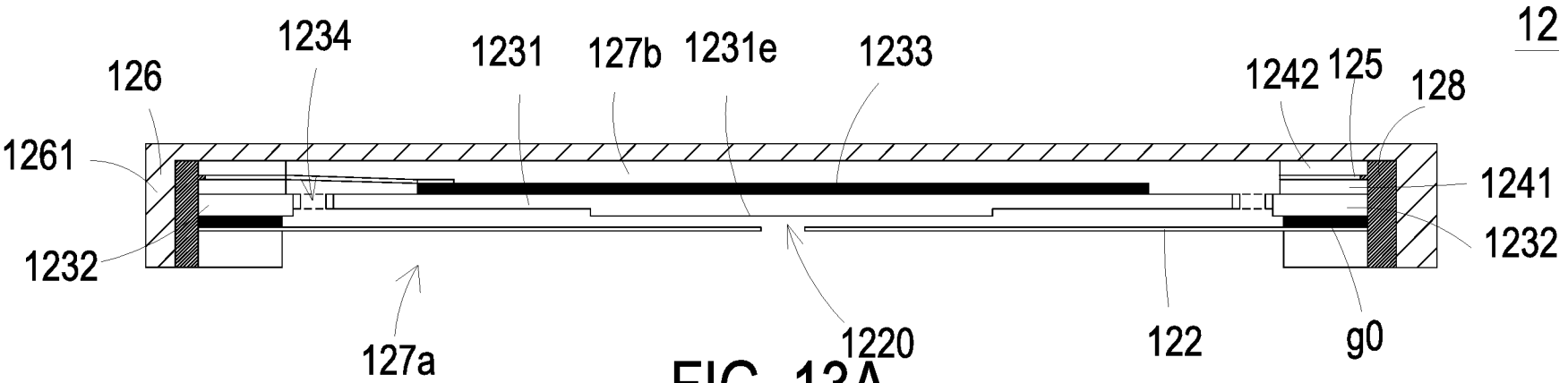
FIGS. 13A to 13D illustrate an operating process of the air pump according to a preferred embodiment of the present disclosure.

The operating process of the first air pump 12 is further described in the following. Please refer to FIGS. 13A to 13D. FIGS. 13A to 13D illustrate an operating process of the air pump according to a preferred embodiment of the present disclosure. Firstly, as shown in FIG. 13A, the structure of the first air pump 12 is similar to that in the foregoing descriptions and assembled and stacked sequentially by the order of the cover plate 126, the second insulation plate 1242, the conducting plate 125, the first insulation plate 1241, the piezoelectric actuator 123 and the resonance plate 122. There is a gap g0 formed between the resonance plate 122 and the piezoelectric actuator 123. Moreover, the resonance plate 122 and the sidewalls 1261 of the cover plate 126 collaboratively define the convergence chamber 127*a*. The first chamber 127*b* is formed between the resonance plate 122 and the piezoelectric actuator 123 spaced apart by the gap g0. When the first air pump 12 has not been driven by a voltage, the positions of the components are illustrated in FIG. 13A.

Figure 13B:
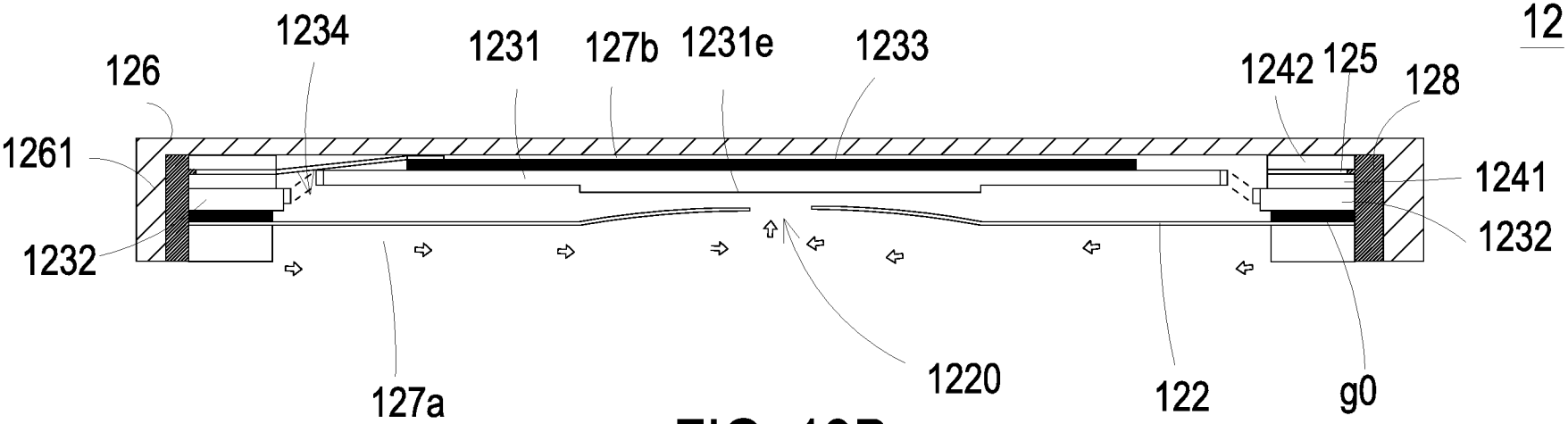

Further as shown in FIG. 13B, when the piezoelectric actuator 123 of the first pump 12 is driven by a voltage and vibrates upwardly, the air is introduced from the opening portion 1263 of the cover plate 126 into the first air pump 12 and converges to the convergence chamber 127*a*. Simultaneously, the resonance plate 122 is influenced by the resonance of the suspension plate 1231 of the piezoelectric actuator 123 to generate a reciprocating vibration. Namely, the resonance plate 122 is deformed upwardly. The resonance plate 122 protrudes slightly at central aperture 1220.

Figure 13C:
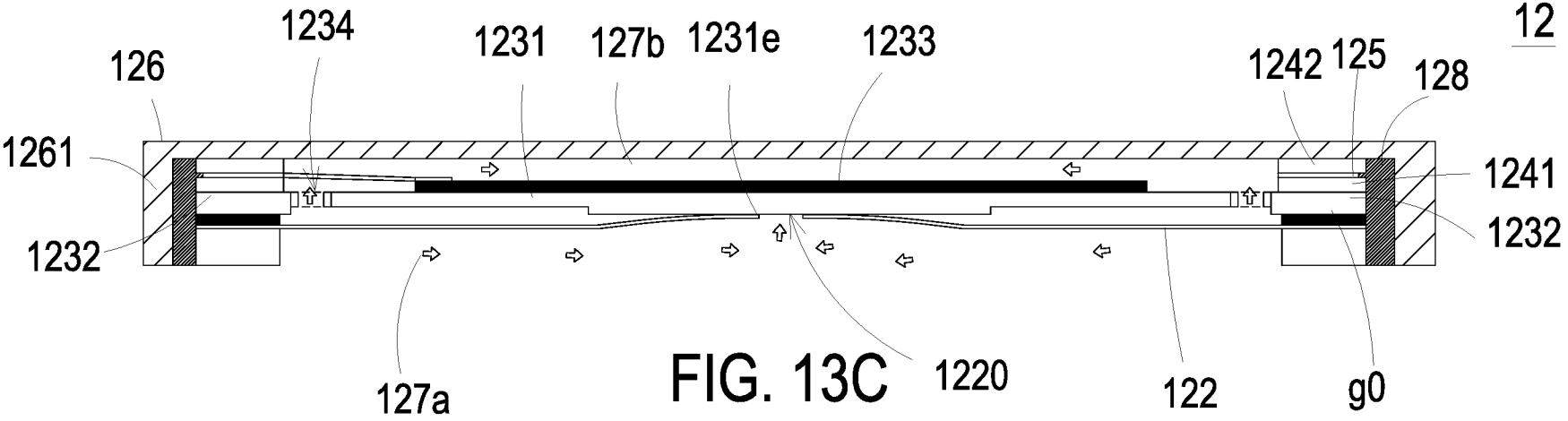

Afterward, as shown in FIG. 13C, the piezoelectric actuator 123 vibrates downwardly to the original position. Meanwhile, the bulge 1231*e* of the suspension plate 1231 of the piezoelectric actuator 123 is close to the upward protruded portion of the resonance plate 122 at the central aperture 1220. It makes the air in the first air pump 12 temporarily stored in the upper half layer of the first chamber 127*b*.

Figure 13D:
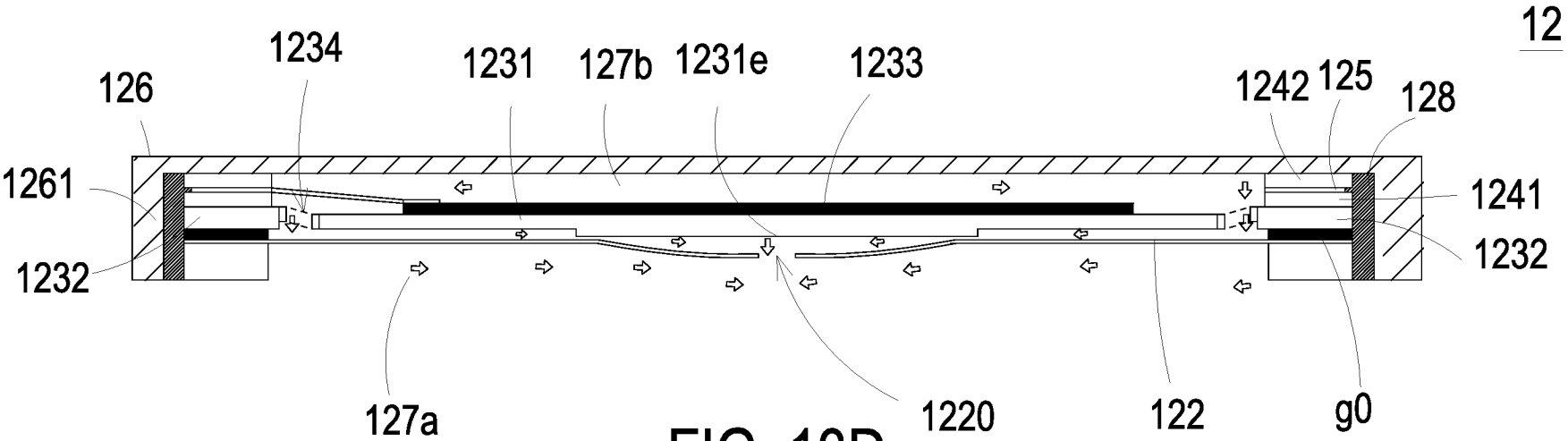

As shown in FIG. 13D, the piezoelectric actuator 123 further vibrates downwardly and the resonance plate 122 also vibrates downwardly due to the resonance of the piezoelectric actuator 123. With the downward deformation of the resonance plate 122 to shrink the volume of the first chamber 127*b*, the air in the upper half layer of the first chamber 127*b* is pushed to flow toward the both sides and pass through the interspace 1234 of the piezoelectric actuator 123 downwardly, so as to be transferred to the central aperture 1220 of the resonance plate 122 and compressed to discharge. With the visible aspect of this embodiment, when the resonance plate 122 performs the vertical reciprocating vibration, the gap g0 between the resonance plate 122 and the piezoelectric actuator 123 facilitates to increase the maximum distance in the vertical displacement. In other words, the gap g0 disposed between the resonance plate 122 and the piezoelectric actuator 123 allows the resonance plate 122 to generate a greater amplitude of the up and down displacement when it is in resonance.

Finally, the resonance plate 122 returns to the original position as shown in FIG. 13A. With the above described operating process, the circulation in the order of FIGS. 13A to 13D is maintained continuously. The air is fed from the opening portion 1263 of the cover plate 126 into the convergence chamber 127*a* and then flows to the first chamber 127*b*. Afterward, the air is further transferred from the first chamber 127*b* to the convergence chamber 127*a*, so that the air flows from the inflatable shoelace 10 to the inflatable shoe tongue 11 continuously and is transferred stably. In other words, when the first air pump 12 of the present disclosure is operated, the air flows through the opening portion 1263 of the cover plate 126, the convergence chamber 127*a*, the first chamber 127*b*, the convergence chamber 127*a* and the inlet opening 204 sequentially. Therefore, the first air pump 12 of the present disclosure provides a single component, the cover plate 126, and utilizes the structural design of the opening portion 1263 of the cover plate 126, so that the number of components of the first air pump 12 can be reduced, and the entire process can be simplified.

Figure 14A:
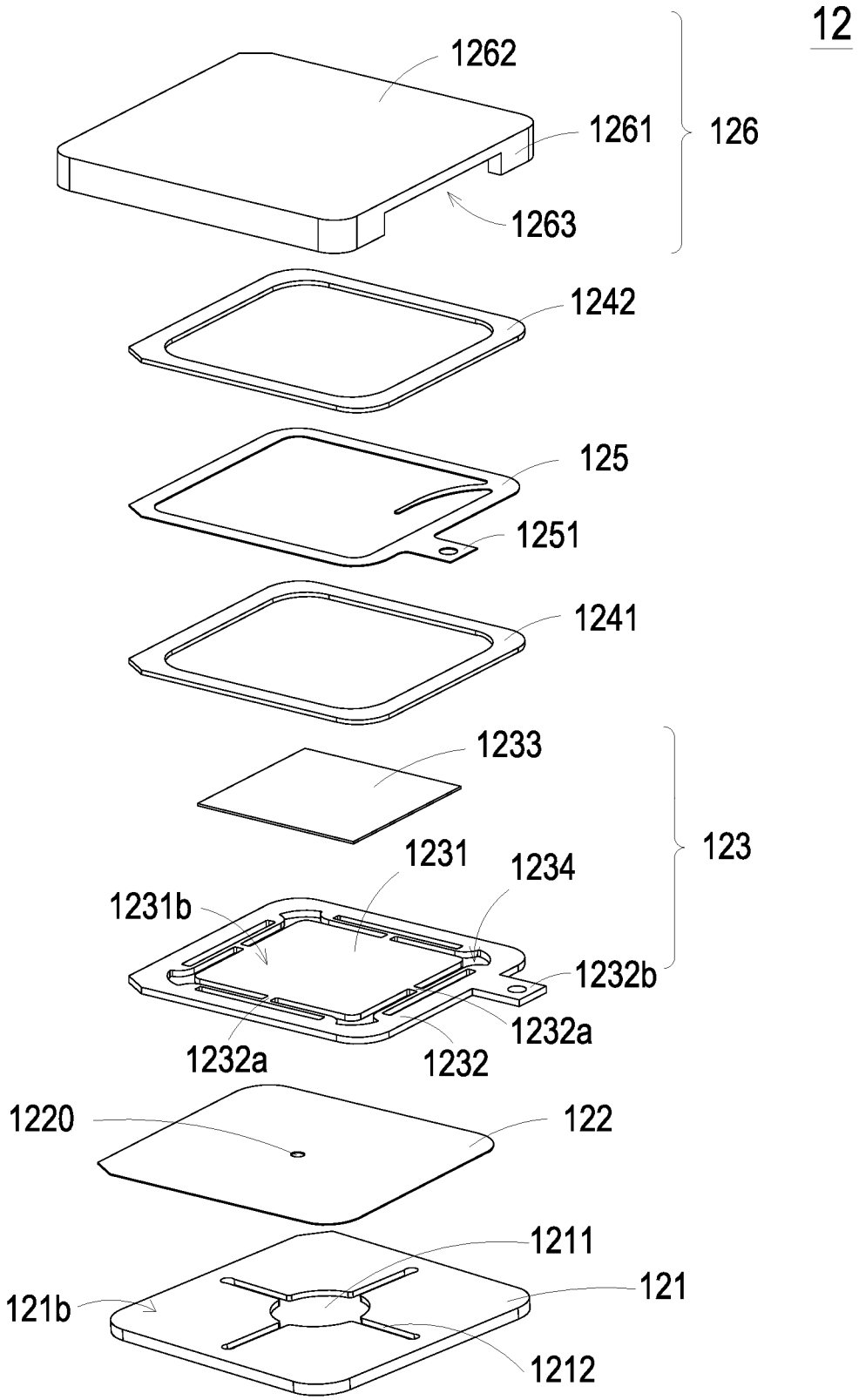
FIG. 14A is a front cross-sectional view illustrating the air pump according to another preferred embodiment of the present disclosure.
Figure 14B:
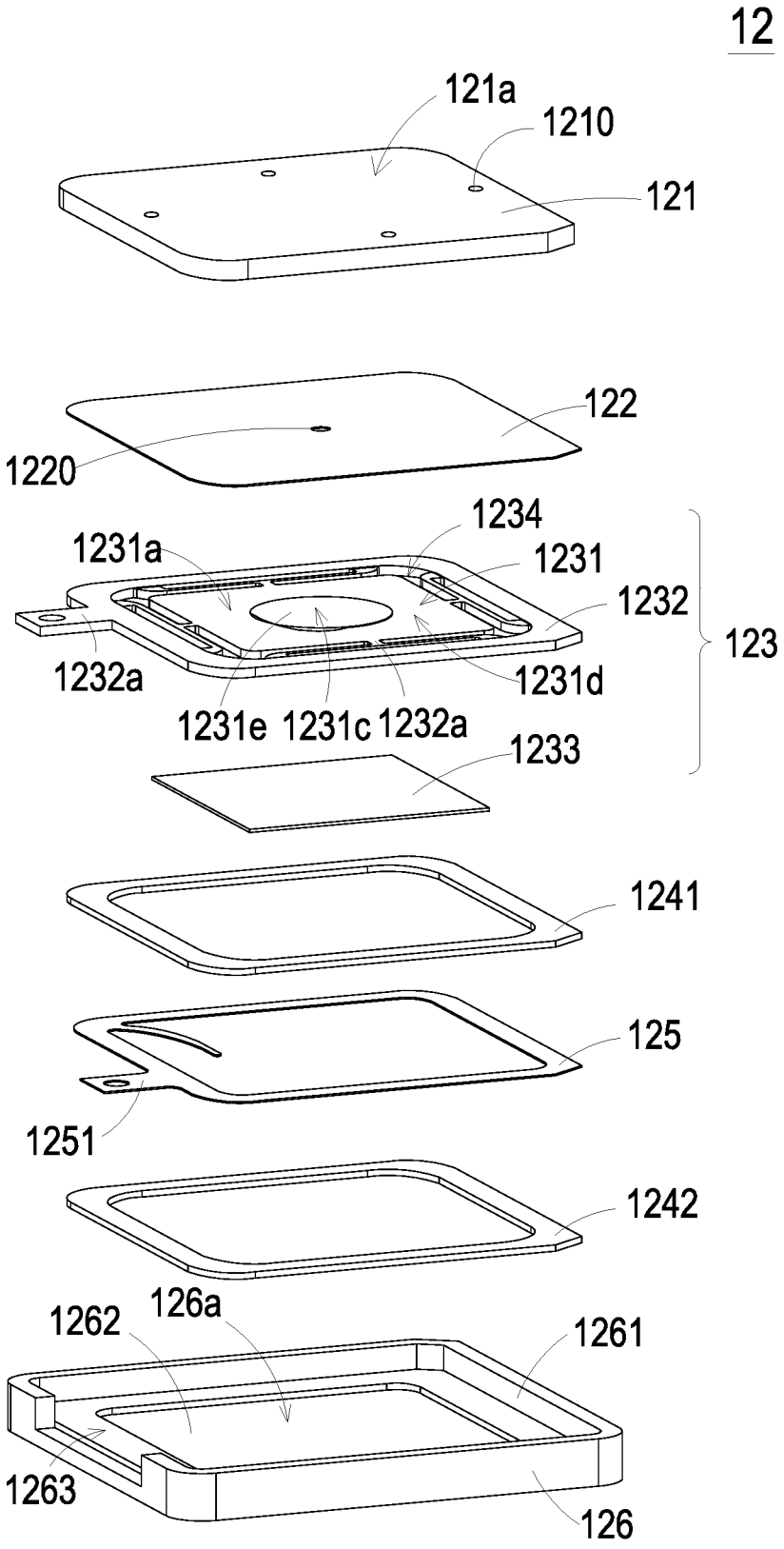
FIG. 14B is a rear cross-sectional view illustrating the air pump of FIG. 14A.

Please refer FIGS. 14A and 14B. FIG. 14A is a front cross-sectional view illustrating the air pump according to another preferred embodiment of the present disclosure. FIG. 14B is a rear cross-sectional view illustrating the air pump of FIG. 14A. In the embodiment, the first air pump 12 includes the cover plate 126, the second insulation plate 1242, the conducting plate 125, the first insulation plate 1241, the piezoelectric actuator 123 and the resonance plate 122 stacked on each other sequentially. The first air pump 12 has the similar structures, elements and configurations as those of the above embodiments and is not redundantly described herein. In the embodiment, the first air pump 12 further includes an inlet plate 121. The inlet plate 121 is aligned with the resonance plate 122 and stacked thereon. The inlet plate 121 includes a first surface 121*a*, a second surface 121*b* and at least one inlet 1210. In the embodiment, the inlet plate 121 has four inlets 1210, but not limited thereto. The inlets 1210 runs through the first surface 121*a* and the second surface 121*b*, so that the air is fed into the first air pump 12 through the at least one inlet 1210 in response to the action of the atmospheric pressure. In addition, as shown in FIG. 14A, the inlet plate 121 includes at least one convergence channel 1212 disposed on the second surface 121*b* and spatially corresponding to the at least one inlet 1210 on the first surface 121*a* of the inlet plate 121. There is a central cavity 1211 formed at the intersection of those convergences channels 1212. The central cavity 1211 is in communication with the convergence channels 1212. Thus, the air fed into the convergence channels 1212 through the at least one inlet 1210 can be converged and transferred to the central cavity 1211, so as to converge the air at the central aperture 1220 of the resonance plate 122 efficiently and transfer the air to the inner of the first air pump 12. That is, the inlet plate 121 is integrally formed by the inlets 1210, the convergence channels 1212 and the central cavity 1211, and a convergence chamber is formed corresponding to the central cavity 1211 to store the air temporarily. In some embodiment, the material of the inlet plate 121 can be for example but not limited to the stainless steel. In other embodiments, the depth of the convergence chamber formed at the central cavity 1211 and the depth of those convergence channels 1212 can be, for example but not limited to, equal. The resonance plate 122 can be made of for example but not limited to a flexible material. Moreover, the resonance plate 122 has a central aperture 1220 corresponding to the central cavity 1211 on the second surface 121*b* of the inlet plate 121, so as to allow the air to flow downwardly. In other embodiments, the resonance plate 122 can be made of for example but not limited to a copper material.

According to the above description, with the action of the first air pump 12, the air is introduced into the inflatable shoe tongue 11 through the inflatable shoelace 10, so that the inflatable shoelace 10 is deflated and relaxed and the inside of the inflatable tongue 11 is expanded due to the inflated air to protrude outwardly. Thus, the openings 24 and the wear space 23 of the sports shoe 2 are expanded to aid the user to wear or take off the sports shoe 2 easily. In addition, the structure of the second air pump 12' of the present disclosure is similar to that of the first air pump 12, and is not redundantly described herein. With the second air pump 12' to pump the air from the inflatable shoe tongue 11 to the airbag 14, the inflatable shoelace 10 can be inflated and tightened and the air in the inflatable shoe tongue 11 can be deflated to shrink inwardly. Thus, the opening 24 and the wear space 23 of the sports shoe 2 are reduced, so as to fix the user's foot within the sports shoe 2 firmly.

In summary, the present disclosure provides a pressure fixing device applied to a shoe. The weight sensor is utilized to detect the pressure of weight to confirm that the user is wearing or the taking-off the shoe. The control module enables the first air pump or the second air pump. When the user is wearing the shoe, the inflatable shoe tongue can be controlled to be deflated and shrunk inwardly and the inflatable shoelace can be controlled to be inflated and tightened, so as to fix the user's foot firmly. When the user is taking off the shoe, the inflatable shoe tongue can be controlled to be inflated and expanded outwardly and the inflatable shoelace can be controlled to be deflated and loosened, so as to aid the user to wear or take off easily. In addition, the pressure fixing device further has the function of adjusting the pressure. With the first and second air pressure sensors to detect the internal pressure of the inflatable shoe tongue and the inflatable shoelace, and the inlet valve to supplement the air when the internal pressure is insufficient, the control module can maintain the internal pressure in a specific range. It avoids the discomfort of the foot due to the over-inflation of the inflatable shoe tongue and the inflatable shoelace or the airbag burst, and provide a more comfortable pressure for the user to wear.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A pressure fixing device applied to a shoe, wherein the shoe comprises a shoe body and a bottom part, the shoe body comprises plural eyelets and the bottom part is connected to the shoe body to define a wear space collaboratively, the pressure fixing device comprising:

an inflatable shoe tongue connected with the shoe body, wherein the inflatable shoe tongue is an inflatable and expandable structure with air, an opening is collaboratively defined by the inflatable shoe tongue and the shoe body, and the opening is in communication with the wear space; and a first air pump in communication with the inflatable shoe tongue;

wherein when the first air pump pumps the air flowing into the inflatable shoe tongue, the inflatable shoe tongue expands and bulges in a direction away from the wear space to enlarge the opening, when the air flowing out of the inflatable shoe tongue, the inflatable shoe tongue shrinks in a direction toward the wear space to attach to an user's instep, wherein the inflatable shoe tongue further comprises an outer airbag, an inner airbag and a two-way valve, wherein the outer airbag comprises an outer surface having plural protrusions protruding outwardly, and a gap is disposed between each two adjacent protrusions of the outer airbag, wherein the inner airbag comprises an inner surface having plural protrusions protruding inwardly, and a gap is disposed between each two adjacent protrusions of the inner airbag, and wherein the two-way valve is a two-way air intake structure and in communication between the outer airbag and the inner airbag, so that the plural protrusions of the outer airbag are expanded in the direction to protrude outwardly to move the inflatable shoe tongue away from the wear space by introducing the air to the outer airbag through the two-way valve, and the plural protrusions of the inner airbag are expanded in the direction to protrude inwardly to move the inflatable shoe tongue to shrink toward the wear space by introducing the air to the inner airbag through the two-way valve.

2. The pressure fixing device according to claim 1, wherein the pressure fixing device further comprises a first air pressure sensor, and the first air pressure sensor is disposed within the inflatable shoe tongue wherein when the first air pressure sensor detects that the inflatable shoe tongue has an internal pressure higher than a specific threshold interval, the first air pump is disabled to stop operating.

3. The pressure fixing device according to claim 1, wherein the pressure fixing device further comprises a shoelace, and the shoelace is disposed within the plural eyelets of the shoe body.

4. The pressure fixing device according to claim 1, wherein the pressure fixing device further comprises:

an inflatable shoelace, wherein the inflatable shoelace is an inflatable and expandable structure, and the inflatable shoelace runs through the plural eyelets of the shoe body;

an additional airbag attached to an outer surface of the inflatable shoe tongue and in communication with the inflatable shoe tongue;

a first air passage and a second air passage in communication between the additional airbag and the inflatable shoelace, respectively, wherein the first air pump disposed within the first air passage; and a second air pump disposed within the second air passage;

wherein when the second air pump is enabled to pump the air flowing from the inflatable shoe tongue to the inflatable shoelace through the second air passage, the inflatable shoe tongue shrinks in the direction toward the wear space and the inflatable shoelace is inflated with the air for expansion to tighten to attach to the user's instep; and when the first air pump is enabled to pump the air flowing from the inflatable shoelace through the first air passage into the additional airbag and the inflatable shoe tongue, the inflatable shoelace is deflated and loosened and the inflatable shoe tongue is inflated with the air for expansion and protrudes in the direction away from the wear space to enlarge the opening, thereby aiding an user to wear the shoe.

5. The pressure fixing device according to claim 4, wherein the pressure fixing device further comprises a switch, wherein while the switch is turned on, the second air pump is enabled; and while the switch is turned off, the first air pump is enabled.

6. The pressure fixing device according to claim 4, wherein the pressure fixing device further comprises a weight sensor, and the weight sensor is disposed on the bottom part of the shoe, wherein when the weight sensor detects that the bottom part of the shoe is pressed, the second air pump is enabled.

7. The pressure fixing device according to claim 4, wherein the pressure fixing device further comprises a first air pressure sensor, and the first air pressure sensor is disposed within the inflatable shoe tongue, wherein when the first air pressure sensor detects that the inflatable shoe tongue has an internal pressure higher than a specific threshold interval, the first air pump is disabled to stop operating, and wherein the pressure fixing device further comprises a second air pressure sensor, and the second air pressure sensor is disposed within the inflatable shoelace, wherein when the second air pressure sensor detects that the inflatable shoelace has an internal pressure higher than the specific threshold interval, the second air pump is disabled to stop operating.

8. The pressure fixing device according to claim 7, wherein the pressure fixing device further comprises an inlet valve embedded in the outer surface of the inflatable shoe tongue, wherein when the first air pressure sensor or the second air pressure sensor detects that the internal pressure of the inflatable shoe tongue or the inflatable shoelace is lower than the specific threshold interval, the inlet valve is driven to introduce the air to the inflatable shoe tongue or the inflatable shoelace.

9. The pressure fixing device according to claim 4, wherein the inflatable shoelace is an artificial-muscle air-inflated shoelace.

10. The pressure fixing device according to claim 4, wherein the inflatable shoelace further comprises at least one lacing part and at least one connecting part, and the at least one lacing part comprises two through holes disposed on two ends thereof, respectively, wherein the at least one lacing part and the at least one connecting part are in communication with each other via the through holes.

11. The pressure fixing device according to claim 10, wherein the lacing part further comprises plural expandable sections and plural communication sections, wherein each of the plural communication sections is connected between two adjacent expandable sections to define plural gaps between two adjacent plural expandable sections, respectively.

12. The pressure fixing device according to claim 11, wherein the plural communication sections are disposed in an up-and-down staggered arrangement having plural communication sections arranged alternately with each other without aligning on the same line, and each of the plural communication sections is connected between two adjacent expandable sections.

13. The pressure fixing device according to claim 1, wherein the first air pump is a piezoelectric air pump, and the piezoelectric air pump comprises:

a resonance plate comprising a central aperture and a movable part, wherein the movable part is disposed around the central aperture;

a piezoelectric actuator spatially corresponding to the resonance plate; and a cover plate comprising at least one sidewall, a bottom plate and an opening portion, wherein the at least one sidewall surrounds and protrudes vertically from a periphery of the bottom plate and an accommodation space is defined by the bottom plate and the at least one sidewall collaboratively, wherein the resonance plate and the piezoelectric actuator are accommodated within the accommodation space, and the opening portion is disposed on the sidewall;

wherein a chamber is formed between the resonance plate and the piezoelectric actuator spaced apart by a gap, wherein while the piezoelectric actuator is enabled, the air is introduced into the opening portion of the cover plate and transferred to the chamber through the central aperture of the resonance plate, so that the movable part of the resonance plate is reciprocated along with the piezoelectric actuator to generate a resonance air flowing.

14. The pressure fixing device according to claim 13, wherein the piezoelectric actuator comprises:

a suspension plate having a first surface and a second surface, wherein the suspension plate is permitted to undergo a bending vibration;

an outer frame arranged outside around the suspension plate;

at least one bracket connected between the suspension plate and the outer frame for elastically supporting the suspension plate; and a piezoelectric element, wherein a length of a side of the piezoelectric element is smaller than or equal to a length of a side of the suspension plate, and the piezoelectric element is attached on the first surface of the suspension plate, wherein when a voltage is applied to the piezoelectric element, the suspension plate is driven to undergo the bending vibration.

15. The pressure fixing device according to claim 14, wherein the suspension plate is a square suspension plate with a bulge.

16. The pressure fixing device according to claim 14, wherein the piezoelectric air pump further comprises a conducting plate, a first insulation plate and a second insulation plate, wherein the resonance plate, the piezoelectric actuator, the first insulation plate, the conducting plate, the second insulation plate and the cover plate are stacked on each other sequentially.

17. The pressure fixing device according to claim 14, wherein the piezoelectric actuator further comprises an inlet plate, and the inlet plate is aligned with the resonance plate and stacked thereon, wherein the inlet plate comprises a first surface, a second surface, at least one inlet, a central cavity and at least one convergence channel, wherein the at least one inlet runs through the first surface and the second surface, the at least one convergence channel is formed on the second surface and in communication with the at least one inlet, the central cavity is formed on the second surface corresponding to the central aperture of the resonance plate, and the central cavity and the at least one convergence channel are communicated with each other, wherein after the air is introduced into the at least one inlet, the air is converged and transferred to the central cavity through the at least one convergence channel, so as to transfer the air into the central aperture of the resonance plate.

* * * * *